US007989134B2

(12) United States Patent
Usami et al.

(10) Patent No.: US 7,989,134 B2
(45) Date of Patent: Aug. 2, 2011

(54) TONER, METHOD FOR MANUFACTURING THE SAME, AND IMAGE FORMING METHOD

(75) Inventors: Toshihiko Usami, Numazu (JP); Masashi Miyakawa, Susono (JP)

(73) Assignee: Ricoh Company, Ltd., Tokyo (JP)

( * ) Notice: Subject to any disclaimer, the term of this patent is extended or adjusted under 35 U.S.C. 154(b) by 809 days.

(21) Appl. No.: 12/019,112

(22) Filed: Jan. 24, 2008

(65) Prior Publication Data

US 2008/0182186 A1 Jul. 31, 2008

(30) Foreign Application Priority Data

Jan. 25, 2007 (JP) ..... 2007-014623

(51) Int. Cl.
*G03G 5/00* (2006.01)

(52) U.S. Cl. ..... 430/137.14; 430/137.15; 430/137.17; 430/109.1

(58) Field of Classification Search ..... 430/137.14, 430/137.15, 137.17, 109.1
See application file for complete search history.

(56) References Cited

U.S. PATENT DOCUMENTS

2006/0216629 A1 9/2006 Miyakawa et al.

FOREIGN PATENT DOCUMENTS

| | | |
|---|---|---|
| EP | 1 617 294 A2 | 1/2006 |
| EP | 1 677 159 A2 | 7/2006 |
| EP | 1 720 077 A2 | 11/2006 |
| JP | 5-66600 | 3/1993 |
| JP | 8-62884 | 3/1996 |
| JP | 2000-275907 | 10/2000 |
| JP | 2005-17582 | 1/2005 |
| JP | 2005-105018 | 4/2005 |
| JP | 2005-173578 | 6/2005 |
| JP | 2006-184829 | 7/2006 |

OTHER PUBLICATIONS

Office Action issued May 10, 2011, in Japanese Patent Application No. 2007-14623, filed Jan. 25, 2007.

*Primary Examiner* — Mark A Chapman
(74) *Attorney, Agent, or Firm* — Oblon, Spivak, McClelland, Maier & Neustadt, L.L.P.

(57) ABSTRACT

To provide a toner manufacturing method including: dissolving or dispersing a toner material into an organic solvent to prepare a toner solution, the toner material containing at least an active hydrogen group-containing compound, polymer reactive with the active hydrogen group-containing compound, binder resin, releasing agent and coloring agent; emulsifying or dispersing the toner solution into an aqueous medium to prepare an emulsified dispersion; reacting the active hydrogen group-containing compound with the polymer reactive with the active hydrogen group-containing compound in the aqueous medium produce an adhesive base material in the form of particle; and removing the organic solvent, wherein time X (hour) from a point where the organic solvent starts to be removed to a point where the concentration of the organic solvent reaches less than 12% by mass and temperature T (° C.) of the emulsified dispersion at the time X satisfy the relationship $5\{\exp(-0.2X)+1\} \leqq T \leqq 50X^{-0.2}$.

10 Claims, 6 Drawing Sheets

TONER, METHOD FOR MANUFACTURING THE SAME, AND IMAGE FORMING METHOD

BACKGROUND OF THE INVENTION

1. Field of the Invention

The present invention relates to a toner for developing an electrostatic charge image in electrophotograph, electrostatic recording, electrostatic printing and the like, a method for manufacturing the toner and an image forming method using the toner.

2. Description of the Related Art

In an electrophotographic image forming apparatus, an electrostatic recording apparatus or the like, toner is attached to a latent electrostatic image formed on a photoconductor, and the developed latent electrostatic image is transferred and fixed to a recording medium to form a toner image thereon. Further, a full-color image formation is to reproduce color in general by using four color toners of yellow, magenta, cyan and black. A full color image is formed by superimposing these color toners on a recording medium followed by heating treatment and fixation to the recording medium.

In general, toners used in developing an electrostatic charge image are color particles containing a coloring agent, a charge control agent and other additives in a binder resin. The manufacturing methods are largely categorized into pulverization methods and polymerization methods. In the pulverization method a toner composition is manufactured in which a coloring agent, a charge control agent, an off-set preventive agent and other agents are melted and mixed with thermoplastic resin in a state of homogeneous dispersion, and the toner composition is pulverized and classified to manufacture a toner. The pulverization method enables low-cost toner manufacturing to be achieved, but it suffers from a drawback that a broader particle size distribution is readily formed, which results in a very low yield upon classification. Further, it is difficult for the pulverization method to uniformly disperse such toner ingredients as a coloring agent and a charge control agent in thermoplastic resin. As a result, these ununiformly dispersed ingredients adversely affect the flowability, developing ability and durability of toner as well as image quality.

In recent years, there has been an increasing demand for higher-quality images that are comparable in resolution and definition to photographs and prints. As a method for manufacturing a toner with a smaller particle diameter and narrower particle size distribution, an emulsion polymerization method is employed that associate fine resin particles to obtain amorphous toner particles. However, toner particles obtained by the emulsion polymerization method may contain bubbles embedded therein that resulted from a surfactant. Therefore, when toner particles further aggregate and coalesce as they are, voids or voids are generated inside the aggregated toner particles, where surfactant and water remaining therein. This may result in problems such as reduced dielectric loss factor, poor charging capability, and background smear in the obtained image. Further, the remaining surfactant may contaminate the photoconductor, charging roller, developing roller and other members, affecting their inherent charging ability. There is also proposed a method of decreasing the void amount by addition of an anti-foaming agent, a metal compound-derived coagulant, fine resin particles or the like (refer to Japanese Patent Application Laid-Open (JP-A) No. 2000-275907). However, this proposal has a disadvantage that added agents affect toner quality and lead to increased costs.

There is also proposed a capsule-type toner prepared using an encapsulation method that involves uniformly encapsulating a coloring agent into particles without using a dispersion stabilizer (refer to JP-A No. 05-66600). However, depending on various conditions such as agitation condition upon phase inversion emulsification, it may result in voids in the resultant toner particles due to involvement of water, reducing the mechanical strength of toner. These toner particles with many voids therein are lower in mechanical strength and may lead to decreased dielectric loss factor and poor charging ability. In addition, toner particles may be crushed in the course of agitation inside a printing machine to generate a fine powder. This fine powder is responsible for adverse influences on a stable image supply, such as change in the charging ability, background smear and fogging due to reduced powder flowability and change in the charge level distribution. Further, there is proposed a method in which a specific organic solvent is used to swell a resin or resin portion of toner particles such that voids therein are reduced (see JP-A No. 08-62884). In this proposal, however, toner particles undesirably undergo surface morphology change by infiltration of organic solvent.

Since voids present inside a toner particle cause problems such as poor charging ability, durability or stability with time and background smears, conventional pulverized toner and polymerized toner both generally offer characteristics with their toner ingredients densely packed. With these toners, however, it is difficult to achieve a lower toner deposition mass per unit area (lower M/A) on paper or the like—a major effect brought about by reducing toner particle diameter—which leads to an increased number of copies per unit mass of toner. Therefore, there has been disclosed a method of attaining a lower toner deposition mass per unit area (lower M/A), while keeping the diameter of toner particles to a minimum extent and ensuring the developing property, transfer property, fixing property and the like. However, no description has been so far made about a method for controlling the quantity of voids (see JP-A No. 2005-17582).

Further, in a method for manufacturing the polymerized toner, it is important to attain a higher productivity, with the quality maintained. It is, therefore, required to control the void ratio inside the toner by using existing steps and processes, without providing any additional steps such as an agent adding step or a new step, and increase the number of copies per unit mass of toner, while keeping the charging property and durability.

BRIEF SUMMARY OF THE INVENTION

An object of the present invention is to provide a toner for development of latent electrostatic images, a manufacturing method thereof and an image forming method, which are capable of obtaining sufficient image density and of reducing the deposited toner amount per unit are area of a recording paper such as paper.

In order to solve the above problem, the present inventors have diligently conducted studies and established that upon preparation of toner using a method that comprises the steps of: dissolving or dispersing a toner material into an organic solvent to prepare a toner solution, the toner material containing at least an active hydrogen group-containing compound, a polymer reactive with the active hydrogen group-containing compound, a binder resin, a releasing agent and a coloring agent; emulsifying or dispersing the toner solution into an aqueous medium to prepare an emulsified dispersion; reacting the active hydrogen group-containing compound with the polymer reactive with the active hydrogen group-containing compound in the aqueous medium produce an adhesive base material in the form of particle; and removing the organic solvent, the time X (hour) from a point where the organic solvent starts to be removed to a point where the concentration of the organic solvent reaches less than 12% by mass and temperature T (° C.) of the emulsified dispersion at the time X are controlled to satisfy the relationship represented by the following formula (1), whereby it is made possible to control the area ratio of voids (or void ratio) over a cross section of toner, to obtain a sufficient image density and to achieve a small deposited toner amount per unit area on paper or the like.

$$5\{\exp(-0.2X)+1\} \leqq T \leqq 50X^{-0.2}. \quad \text{Formula (1)}$$

The present invention is based on the above-described findings made by the present inventors. The following is means for solving the above problem. That is:

<1> A toner manufacturing method including: dissolving or dispersing a toner material into an organic solvent to prepare a toner solution, the toner material containing at least an active hydrogen group-containing compound, a polymer reactive with the active hydrogen group-containing compound, a binder resin, a releasing agent and a coloring agent; emulsifying or dispersing the toner solution into an aqueous medium to prepare an emulsified dispersion; reacting the active hydrogen group-containing compound with the polymer reactive with the active hydrogen group-containing compound in the aqueous medium produce an adhesive base material in the form of particle; and removing the organic solvent, wherein time X (hour) from a point where the organic solvent starts to be removed to a point where the concentration of the organic solvent reaches less than 12% by mass and temperature T (° C.) of the emulsified dispersion at the time X satisfy the relationship $5\{\exp(-0.2X)+1\} \leqq T \leqq 50X^{-0.2}$.

<2> The Toner Manufacturing Method According to <1>, wherein the temperature T of the emulsified dispersion at the time X is from 10° C. to 70° C.

<3> The toner manufacturing method according to one of <1> and <2>, wherein the time X is 15 hours or less and the temperature T is 40° C. or lower.

<4> The toner manufacturing method according to any one of <1> to <3>, wherein the organic solvent is removed at least either under reduced pressure or on heating.

<5> The toner manufacturing method according to <4>, wherein the heating is conducted by allowing one of hot water and steam to pass through a jacket mounted to the outer circumference of a storage tank which accommodates the organic solvent or by heating the storage tank by means of a heater.

<6> The toner manufacturing method according to one of <4> and <5>, wherein the pressure is reduced to a level of −80 kPa or less.

<7> The toner manufacturing method according to any one of <1> to <6>, wherein the binder resin contains a polyester resin.

<8> A toner manufactured by the toner manufacturing method according to any one of <1> to <7>

<9> The toner according to <8>, wherein a cross section of the toner has a void ratio of from 0.1% to 10%.

<10> An image forming method including: forming a latent electrostatic image on a latent electrostatic image bearing member; developing the latent electrostatic image using a toner to form a visible image; transferring the visible image to a recording medium; and fixing the visible image to the recording medium, wherein the toner is the tone according to one of <8> and <9>.

Upon preparation of toner using a method that comprises the steps of: dissolving or dispersing a toner material into an organic solvent to prepare a toner solution, the toner material containing at least an active hydrogen group-containing compound, a polymer reactive with the active hydrogen group-containing compound, a binder resin, a releasing agent and a coloring agent; emulsifying or dispersing the toner solution into an aqueous medium to prepare an emulsified dispersion; reacting the active hydrogen group-containing compound with the polymer reactive with the active hydrogen group-containing compound in the aqueous medium produce an adhesive base material in the form of particle; and removing the organic solvent, the time X (hour) from a point where the organic solvent starts to be removed to a point where the concentration of the organic solvent reaches less than 12% by mass and temperature T (° C.) of the emulsified dispersion at the time X are controlled to satisfy the relationship represented by the following formula (1). Thus it is made possible to control the area ratio of voids (or void ratio) over a cross section of toner, to obtain a sufficient image density and to achieve a small deposited toner amount per unit area on paper or the like.

$$5\{\exp(-0.2X)+1\} \leqq T \leqq 50X^{-0.2}. \quad \text{Formula (1)}$$

The toner of the present invention is manufactured by the toner manufacturing method of the present invention, thus making it possible to provide a sufficient image density and also to attain a small toner deposition mass per unit area on paper or the like.

The image forming method of the present invention includes at least a latent electrostatic image forming step, a developing step, a transfer step and a fixing step. According to the image forming method, in the latent electrostatic image forming step, a latent electrostatic image is formed on a latent electrostatic image bearing member. In the developing step, the latent electrostatic image is developed by using the toner of the present invention to form a visible image. In the transfer step, the visible image is transferred to a recording medium. In the fixing step, the visible image transferred to the recording medium is fixed thereto. As a result, it is possible to provide a sufficient image density, attain a smaller toner deposition mass per unit area on a recording medium such as paper and also obtain a high-quality electrophotographic image.

Figure 1:
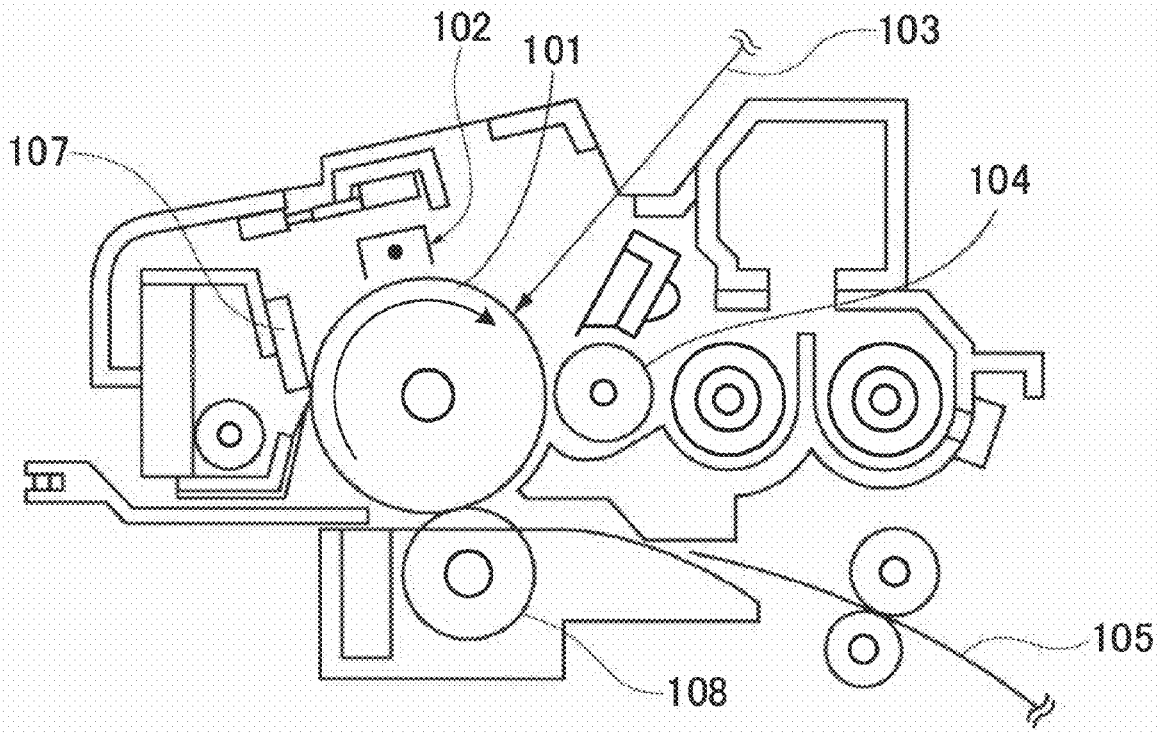
FIG. 1 is a schematic explanatory view showing an example of a process cartridge.

DETAILED DESCRIPTION OF THE INVENTION (Toner and Toner Manufacturing Method)

The toner manufacturing method of the present invention is that in which a toner material containing at least an active hydrogen group-containing compound, a polymer reactive with the active hydrogen group-containing compound, a binder resin, a releasing agent and a coloring agent is dissolved or dispersed in an organic solvent to prepare a toner solution, thereafter, the toner solution is emulsified or dispersed in an aqueous medium to prepare an emulsified dispersion, the active hydrogen group-containing compound and the polymer reactive with the active hydrogen group-containing compound are allowed to react in the aqueous medium to produce an adhesive base material in particles, thereby removing the organic solvent.

The toner of the present invention is manufactured by the toner manufacturing method of the present invention.

Hereinafter, a description will be given in detail of the toner of the present invention by referring to the toner manufacturing method of the present invention.

In the present invention, time X (hour) from the starting point for starting to remove the organic solvent until the concentration of the organic solvent reaches less than 12% by mass and temperature T (° C.) of the emulsified dispersion at the time X satisfy the formula (1) given below, $$5\{\exp(-0.2X)+1\} \leqq T \leqq 50X^{-0.2} \quad \text{Formula (1)}$$

Here, in a step of removing the organic solvent, not only an organic solvent in oil droplets but also carbon dioxide, water, air and the like taken inside are allowed to be gradually released outside the oil droplets at least either on heating or under reduced pressure. Accordingly, curing reaction of a resin contained in the oil droplet proceeds due to given thermal energy, thereby forming a cured film so as to cover the oil droplet. When degassing reaction (removal of organic solvent, carbon dioxide, water, air and the like from the oil droplet) are completed before the cured film is completely formed, a resin, which is still soft, is solidified so as to fill voids formed inside. Therefore, the voids hardly remain. On the other hand, when the degassing reaction takes place after complete formation of the cured film, voids made after the degassing remain, as they are, due to a fact that the resin has been already cured, resulting in a greater void ratio. In other words, the void ratio of toner is determined by degassing speed from the inside of an oil droplet and the curing speed of resin. Therefore, in the toner manufacturing method of the present invention, the void ratio of toner can be controlled by referring to time X necessary for a step of removing an organic solvent to a predetermined concentration (less than 12% by mass) and temperature T of an emulsified dispersion.

In this instance, the time X is preferably 15 hours or less, and the temperature T is preferably 40° C. or lower and more preferably 30° C. or lower. In this range, a resin contained in an oil droplet is prevented from dissolving into an organic solvent to avoid the deteriorated quality of toner, thereby controlling the void ratio.

In the step of removing the organic solvent, the temperature T of the emulsified dispersion until the concentration of the remaining organic solvent arrives at least at less than 12% by mass is preferably from 10° C. to 70° C., and more preferably from is 20° C. to 40° C. When the temperature is less than 10° C., the organic solvent is volatilized slowly to take a longer time in removal, thereby reducing productivity. When the temperature exceeds 70° C., fusing between toners and dissolving of the resin inside the toner into the organic solvent may occur, thereby deteriorating the quality of toner. Further, at the temperature of 70° C. or higher, before removal of the organic solvent, a cured film of resin is formed, and degassing phenomenon (removal of solvent, carbon dioxide, water, air and the like) takes place, with this state kept, thereby causing large voids inside toner to increase the void ratio.

The concentration of organic solvent can be measured for example by gas chromatography.

There is no particular restriction on the organic solvent as long as it is a solvent which can dissolve or disperse the toner material. Any appropriate solvents can be selected depending on the object, including, for example, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. Of these substances, preferable are toluene, xylene, benzene, methylene chloride, 1,2-dichloroethane, chloroform, and carbon tetrachloride. They may be used solely or in combination. Of these compounds, ethyl acetate is particularly preferable.

Where two or more of the organic solvents are used and the concentration of a major organic solvent is 80% by mass or more, the concentration of the major organic solvent is used. Further, the concentration of the major organic solvent is less than 80% by mass, a total concentration of these organic solvents is used.

The starting point for starting to remove the organic solvent means a point at which the concentration of the organic solvent starts to decrease. The starting point can be obtained by gas chromatography by which the concentration of the organic solvent remaining in an emulsified dispersion before and after the start of removing the organic solvent is measured at every predetermined interval.

It is preferable that the organic solvent be removed at least either under reduced pressure or on heating. Thereby, the organic solvent is volatilized at an increased speed, making it possible not only to improve productivity but also to control the void ratio in toner by controlling the volatilization speed depending on the degree of reduced pressure. Further, there is a case that a resin, that is, a major component of toner, is soluble in an organic solvent. In this case, the organic solvent can be quickly removed under reduced pressure, thereby preventing fusing between toners to avoid a deteriorating quality of toner.

It is preferable that the above heating is conducted by allowing one of hot water and steam to pass through a jacket installed on the outer circumference of a storage tank, which accommodates an organic solvent or by heating the storage tank, which accommodates an organic solvent, by means of a heater.

It is preferable that the pressure be reduced to a level of −80 kPa or less.

-Void Ratio of Toner-

The area ratio of voids or void ratio over a cross section of toner is a measure of characterizing a porous substance, and means the ratio of volume V occupied by voids to total volume Vt of a given substance, V/Vt. In general, the void ratio can be found by measuring the specific gravity of a substance including voids (apparent specific gravity) and the specific gravity excluding the voids (true specific gravity). However, since the apparent specific gravity of a powder not uniform in surface configuration such as toner is predominantly influenced by the surface morphology, it is difficult to calculate the void ratio using the apparent specific gravity. Thus, in the present invention, the void ratio of toner is calculated using the area of voids over a cross section of toner and is used for evaluations.

Specifically, a toner to be measured is fixed and retained on a substrate after being embedded into resin or the like, and the surface of the toner-embedded resin is subjected to smoothing treatment by the use of Ultra Microtome (RM2265, made by Leica Camera AG). Thereafter, the surface of the resin on the substrate is photographed using a scanning-type electron microscope (FE-SEM S-4800, made by Hitachi Ltd.). Measurements were made on five or more standard sites and followed by binarization using Photoshop. Then, image processing software (Image Plus Pro) is used to evaluate the size and distribution of voids for the calculation of void ratio in terms of area ratio (%) of voids to the toner area. It is preferable to analyze a total of 300 particles or more as toner particles for one sample. This is because it is known that samples are less likely to be damaged with the above-described method than with a conventional method in which an ultra thin slice cut with a microtome is observed using a transmission electron microscope (TEM), and in particular, that when a low-viscoelastic toner having the lower-temperature fixing property or a toner having voids is cut into an ultra thin slice with a microtome, the particle is deformed and thereby voids are crushed, thus making it difficult to accurately observe and evaluate the slice for an internal state that the toner particles should originally have.

The above-described void ratio of toner is preferably from 0.1% to 10%, more preferably from 0.5% to 7.5% and still more preferably from 1% to 6.5%.

Where the void ratio is less than 0.1%, there is found a lower effect of decreasing the mass of toner per apparent volume of toner particles, which is an effect of voids, thus resulting in a failure in increasing the number of copies per unit mass of toner. On the other hand, where the void ratio exceeds 10%, it is difficult to form particles and also difficult to retain the configuration of toner, thereby, particle collapse or the like takes place due to the development stress and the like to undesirably cause carrier contamination (carrier spent) and the like. Further, toner cartridges and toner bottles are now available in a smaller size, and the container volume is designed in view of the bulk density of toner, so that the toner is densely loaded with no spaces left. Therefore, where the void ratio exceeds 10%, the toner loading time becomes longer and thereby productivity decreases and/or the loading pressure is increased to cause blocking, which may result in a failure of toner supply.

<Toner Material>

The toner material contains at least an adhesive base material which is obtained by allowing an active hydrogen group-containing compound, a polymer reactive with the active hydrogen group-containing compound, a binder resin, a releasing agent and a coloring agent to react. The material also contains other components such as fine resin particles and a charge control agent, whenever necessary.

-Adhesive Base Material-

The adhesive base material, which is adhesive to a recording medium such as paper, contains at least an adhesive polymer obtained by allowing the active hydrogen group-containing compound and the polymer reactive with the active hydrogen group-containing compound to react in the aqueous medium. The material may also contain a binder resin appropriately selected from known binder resins.

There is no particular restriction on the weight average molecular weight of the adhesive base material, and any weight average molecular weight may be appropriately selected, depending on the object. The molecular weight is preferably, for example, 1,000 or more, more preferably from 2,000 to 10,000,000, and particularly preferably from 3,000 to 1,000,000.

Where the weight average molecular weight is less than 1,000, hot offset resistance may be deteriorated.

There is no particular restriction on the storage elastic modulus of the adhesive base material, and any storage elastic modulus can be appropriately selected, depending on the object. Temperature (TG') giving, for example, 10,000 dyne/$cm^2$ at the measuring frequency of 20 Hz, is usually 100° C. or higher, and preferably from 110° C. to 200° C. Where the temperature (TG') is less than 100° C., the hot offset resistance may be deteriorated.

There is no particular restriction on the viscosity of the adhesive base material, and any viscosity can be appropriately selected, depending on the object. Temperature (Tη) giving, for example, 1,000 poises at the measuring frequency of 20 Hz is usually 180° C. or lower, and preferably from 90° C. to 160° C. Where the temperature (Tη) exceeds 180° C., the lower-temperature fixing property may be deteriorated.

Therefore, in view of attaining the hot offset resistance and the low-temperatures fixing property at the same time, the temperature (TG') is preferably higher than the temperature (Tη). In other words, a difference between (TG') and (Tη), that is, (TG'-Tη), is preferably 0° C. or higher, preferably 10° C. or higher, and more preferably 20° C. or higher. The greater this difference, the more it is preferable.

Further, in view of attaining the lower-temperature fixing property and heat-resistant storage stability at the same time, the difference (TG'-η) is preferably from 0° C. to 100° C., more preferably from 10° C. to 90° C. and still more preferably from 20° C. to 80° C.

There is no particular restriction on an example of the adhesive base material, and any material may be appropriately selected, depending on the object. Polyester resins are particularly appropriately used.

There is no particular restriction on the polyester-based resins, and any resin may be selected appropriately, depending on the object. For example, urea modified polyester resins are particularly appropriately used.

The above-described urea modified polyester resins are obtained by allowing amines (B) as the active hydrogen group-containing compound and an isocyanate group-containing polyester prepolymer (A) as a polymer reactive with the active hydrogen group-containing compound to react in the aqueous medium.

The urea modified polyester resins may contain a urethane bond other than a urea bond. In this instance, there is no particular restriction on a content molar ratio of the urea bond to the urethane bond (urea bond/urethane bond), and any ratio may be appropriately selected, depending on the object, preferably from 100/0 to 10/90, more preferably from 80/20 to 20/80, and still more preferably from 60/40 to 30/70. Where the urea bond is less than 10, there is a case that the hot offset resistance may be deteriorated.

Preferred examples of the urea modified polyester resins include (1) to (10) given below. In other words, preferable are (1) a mixture of a urea modified product of polyester prepolymer obtained by allowing a polycondensate of bisphenol A ethylene oxide 2-mole addition product and isophthalic acid to react with isophorone diisocyanate through the use of isophorone diamine with a polycondensate of bisphenol A ethylene oxide 2-mole addition product and isophthalic acid, (2) a mixture of a urea modified product of polyester prepolymer obtained by allowing a polycondensate of bisphenol A ethylene oxide 2-mole addition product and isophthalic acid to react with isophorone diisocyanate through the use of isophorone diamine with a polycondensate of bisphenol A ethylene oxide 2-mole addition product and terephthalic acid, (3) a mixture of a urea modified product of polyester prepolymer obtained by allowing a polycondensate of bisphenol A ethylene oxide 2-mole addition product/bisphenol A propylene oxide 2-mole addition product and terephthalic acid to react with isophorone diisocyanate through the use of isophorone diamine with a polycondensate of bisphenol A ethylene oxide 2-mole addition product/bisphenol A propylene oxide 2-mole addition product and terephthalic acid, (4) a mixture of a urea modified product of polyester prepolymer obtained by allowing a polycondensate of bisphenol A ethylene oxide 2-mole addition product/bisphenol A propylene oxide 2-mole addition product and terephthalic acid to react with isophorone diisocyanate through the use of isophorone diamine with a polycondensate of bisphenol A propylene oxide 2-mole addition product and terephthalic acid, (5) a mixture of a urea modified product of polyester prepolymer obtained by allowing a polycondensate of bisphenol A ethylene oxide 2-mole addition product and terephthalic acid to react with isophorone diisocyanate through the use of hexamethylene diamine with a polycondensate of bisphenol A ethylene oxide 2-mole addition product and terephthalic acid, (6) a mixture of a urea modified product of polyester prepolymer obtained by allowing a polycondensate of bisphenol A ethylene oxide 2-mole addition product and terephthalic acid to react with isophorone diisocyanate through the use of hexamethylene diamine with a polycondensate of bisphenol A ethylene oxide 2-mole addition product/bisphenol A propylene oxide 2-mole addition product and terephthalic acid, (7) a mixture of a urea modified product of polyester prepolymer obtained by allowing a polycondensate of bisphenol A ethylene oxide 2-mole addition product and terephthalic acid to react with isophorone diisocyanate through the use of ethylene diamine with a polycondensate of bisphenol A ethylene oxide 2-mole addition product and terephthalic acid, (8) a mixture of a urea modified product of polyester prepolymer obtained by allowing a polycondensate of bisphenol A ethylene oxide 2-mole addition product and isophthalic acid to react with diphenylmethane diisocyanate through the use of hexamethylene diamine with a polycondensate of bisphenol A ethylene oxide 2-mole addition product and isophthalic acid, (9) a mixture of a urea modified product of polyester prepolymer obtained by allowing a polycondensate of bisphenol A ethylene oxide 2-mole addition product/bisphenol A propylene oxide 2-mole addition product and terephthalic acid/dodecenylsuccinic anhydride to react with diphenylmethane diisocyanate through the use of hexamethylene diamine with a polycondensate of bisphenol A ethylene oxide 2-mole addition product/bisphenol A propylene oxide 2-mole addition product and terephthalic acid, and (10) a mixture of a urea modified product of polyester prepolymer obtained by allowing a polycondensate of bisphenol A ethylene oxide 2-mole addition product and isophthalic acid to react with toluenediisocyanate through the use of hexamethylene diamine with a polycondensate of bisphenol A ethylene oxide 2-mole addition product and isophthalic acid.

--Active Hydrogen Group-Containing Compound--

The active hydrogen group-containing compound acts as an elongation agent, a cross-linking agent and the like in subjecting a polymer reactive with the active hydrogen group-containing compound in the aqueous medium to elongation reaction, cross linking reaction or others.

There is no particular restriction on the active hydrogen group-containing compound, as long as it contains an active hydrogen group. Any compound may be appropriately selected, depending on the object. For example, where a polymer reactive with the active hydrogen group-containing compound is the isocyanate group-containing polyester prepolymer (A), the amines (B) are favorably used in that a high molecular weight can be obtained by being subjected to elongation reaction, cross linking reaction or others with the isocyanate group-containing polyester prepolymer (A).

There is no particular restriction on the active hydrogen group, and any active hydrogen group can be appropriately selected, depending on the object, including, for example, a hydroxyl group (alcoholic hydroxyl group or phenol hydroxyl group), amino group, carboxyl group, and mercapto group. They may be used solely or in combination. Of these groups, an alcoholic hydroxyl group is particularly preferable.

There is no particular restriction on the amines (B), and any amine can be appropriately selected, depending on the object, including, for example, diamine (B1), trivalent or higher polyamine (B2), amino alcohol (B3), amino mercaptan (B4), amino acid (B5), and blocked products of the above-described B1 to B5 amino groups (B6).

They may be used solely or in combination. Of these substances, particularly preferable are diamine (B1) and a mixture of diamine (B1) with a small quantity of trivalent or higher polyamine (B2).

The diamine (B1) includes, for example, aromatic diamine, alicyclic diamine and aliphatic diamine. The aromatic diamine includes, for example, phenylene diamine, diethyl toluene diamine, and 4,4'-diaminodiphenyl methane. The alicyclic diamine includes, for example, 4,4'-diamino-3,3' dimethyl dicyclohexyl methane, diamine cyclohexane, and isophorone diamine. The aliphatic diamine includes, for example, ethylene diamine, tetramethylene diamine and hexamethylene diamine.

The trivalent or higher polyamine (B2) includes, for example, diethylene triamine, and triethylene tetramine.

The amino-alcohol (B3) includes, for example, ethanolamine, and hydroxyethylaniline.

The amino mercaptan (B4) includes, for example, aminoethyl mercaptan, and aminopropyl mercaptan.

The amino acid (B5) includes, for example, aminopropionic acid, and aminocaproic acid.

Blocked products of the B1 to B5 amino groups (B6) include, for example, ketimine compounds obtained from any one of amines of the (B1) to (B5) and ketones (acetone, methyl ethyl ketone, methyl isobutyl ketone and the like), and oxazoline compounds.

It is noted that a reaction terminator is used to stop reactions such as elongation reaction and cross linking reaction of the active hydrogen group-containing compound with a polymer reactive with the active hydrogen group-containing compound. The reaction terminator is preferably used in that the molecular weight of the adhesive base material and the like can be controlled to a desired range. The reaction terminator includes monoamines (diethylamine, dibutylamine, butylamine, laurylamine and the like), and their blocked products (ketimine compounds).

A mixture ratio of the amines (B) to the isocyanate group-containing polyester prepolymer (A), that is, a mixture equivalent ratio ([NCO]/[NHx]) of isocyanate group [NCO] in the isocyanate group-containing prepolymer (A) to amino group [NHx] in the amines (B) is preferably from 1/3 to 3/1, more preferably from 1/2 to 2/1, and particularly preferably from 1/1.5 to 1.5/1.

Where the mixture equivalent ratio ([NCO]/[NHx]) is less than ⅓, the low-temperature fixing property may be decreased. Where the mixture equivalent ratio exceeds 3/1, the urea modified polyester resin may be decreased in molecular weight to deteriorate the hot offset resistance.

--Polymer Reactive with Active Hydrogen Group-Containing Compound--

There is no particular restriction on a polymer reactive with the active hydrogen group-containing compound (hereinafter, it may be referred to as "prepolymer") as long as it contains at least a site reactive with the active hydrogen group-containing compound. The polymer can be appropriately selected from any known resins and the like, including, for example, a polyol resin, a polyacryl resin, a polyester resin, an epoxy resin, and derivative resins of them.

They may be used solely or in combination. Of these resins, particularly preferable is a polyester resin in terms of high flowability on melting and transparency.

There is no particular restriction on a site reactive with the active hydrogen group-containing compound in the prepolymer, and the site can be appropriately selected from any known substituents, including, for example, an isocyanate group, an epoxy group, a carboxylic acid and an acid chloride group.

They may be used solely or in combination. Of these groups, an isocyanate group is particularly preferable.

Of the prepolymers, particularly preferable is a urea bond-generating group-containing polyester resin (RMPE) in that polymeric components can be easily adjusted for the molecular weight, thus making it possible to secure the low-temperature fixing property of oil-free dry-type toner and also to secure favorable mold releasability and fixing property particularly where no releasing oil coating mechanism is provided for a fixing heating medium.

The urea bond-generating group includes, for example, an isocyanate group. Where the urea bond-generating group in the urea bond-generating group-containing polyester resin (RMPE) is the isocyanate group, the isocyanate group-containing polyester prepolymer (A) is particularly preferably used as the polyester resin (RMPE).

There is no particular restriction on the isocyanate group-containing polyester prepolymer (A), and any prepolymer can be selected appropriately, depending on the object, including, for example, a polycondensate of polyol (PO) with polycarboxylic acid (PC), which is obtained by allowing the active hydrogen group-containing polyester resin to react with polyisocyanate (PIC).

There is no particular restriction on the polyol (PO), and any polyol can be appropriately selected, depending on the object, including, for example, diol (DIO), trivalent or higher polyol (TO), and a mixture of diol (DIO) with trivalent or higher polyol (TO). They may be used solely or in combination with two or more of them. Of these polyols, preferable are the diol (DIO) by itself and a mixture of the diol (DIO) with a small quantity of the trivalent or higher polyol (TO).

The diol (DIO) includes, for example, alkylene glycols, alkylene ether glycols, alicyclic diols, alkylene oxide adducts of alicyclic diol, bisphenols, and alkylene oxide adducts of bisphenols.

The alkylene glycols are preferably those with 2 to 12 carbon atoms, including, for example, ethylene glycol, 1,2-propylene glycol, 1,3-propylene glycol, 1,4-butane diol, and 1,6-hexane diol. The alkylene ether glycols include, for example, diethylene glycol, triethylene glycol, dipropylene glycol, polyethylene glycol, polypropylene glycol, and polytetramethylene ether glycol. The alicyclic diols include, for example, 1,4-cyclohexane dimethanol, and hydrogenated bisphenol A. The alkylene oxide adducts of alicyclic diol include, for example, those obtained by adding alkylene oxides such as ethylene oxide, propylene oxide and butylene oxide to the alicyclic diol. The bisphenols include, for example, bisphenol A, bisphenol F, and bisphenol S. Alkylene oxide adducts of the bisphenols include, for example, those obtained by adding alkylene oxides such as ethylene oxide, propylene oxide and butylene oxide to the bisphenols.

Of these substances, preferable are alkylene glycols with 2 to 12 carbon atoms, alkylene oxide adducts of bisphenols, and particularly preferable are alkylene oxide adducts of bisphenols, and a mixture of alkylene oxide adducts of bisphenols with alkylene glycols with 2 to 12 carbon atoms.

The above-described trivalent or higher polyols (TO) are preferably trivalent to octavalent or higher polyols, including, for example, trivalent or higher multivalent aliphatic alcohols, trivalent or higher polyphenols, and alkylene oxide adducts of trivalent or higher polyphenols.

The trivalent or higher multivalent aliphatic alcohols include, for example, glycerin, trimethylol ethane, trimethylol propane, pentaerythritol, and sorbitol. The trivalent or higher polyphenols include, for example, trisphenol PA, phenol novolac and cresol novolac. The alkylene oxide adducts of trivalent or higher polyphenols include, for example, those obtained by adding alkylene oxides such as ethylene oxide, propylene oxide and butylene oxide to the trivalent or higher polyphenols.

A mixture mass ratio (DIO:TO) of the diol (DIO) to the trivalent or higher polyol (TO) in a mixture of the diol (DIO) with the trivalent or higher polyol (TO) is preferably from 100:0.01 to 100:10, and more preferably from 100:0.01 to 100:1.

There is no particular restriction on the polycarboxylic acid (PC), and any polycarboxylic acid can be appropriately selected, depending on the object, including, for example, dicarboxylic acid (DIC), trivalent or higher polycarboxylic acid (TC), and a mixture of dicarboxylic acid (DIC) with trivalent or higher polycarboxylic acid.

They may be used solely or in combination. Of these substances, preferable are dicarboxylic acid (DIC) by itself, and a mixture of DIC with a small quantity of trivalent or higher polycarboxylic acid (TC).

The dicarboxylic acid includes, for example, alkylene dicarboxylic acid, alkenylene dicarboxylic acid, and aromatic dicarboxylic acid.

The alkylene dicarboxylic acid includes, for example, succinic acid, adipic acid, and sebacic acid. The alkenylene dicarboxylic acid are preferably those with 4 to 20 carbon atoms, including, for example, maleic acid and fumaric acid. The aromatic dicarboxylic acids are preferably those with 8 to 20 carbon atoms, including, for example, phthalic acid, isophthalic acid, terephthalic acid, and naphthalene dicarboxylic acid.

Of these substances, preferable are alkenylene dicarboxylic acids 4 to 20 carbon atoms and aromatic dicarboxylic acids of 8 to 20 carbon atoms.

The trivalent or higher polycarboxylic acid (TO) is preferably trivalent to octavalent or higher polycarboxylic acid, including, for example, aromatic polycarboxylic acid.

The aromatic polycarboxylic acids are preferably those with 9 to 20 carbon atoms, including, for example, trimellitic acid and pyromellitic acid.

The polycarboxylic acid (PC) includes any acid anhydride selected from the dicarboxylic acid (DIC), the trivalent or higher polycarboxylic acid (TC) and a mixture of the dicarboxylic acid (DIC) with the trivalent or higher polycarboxylic acid, or lower alkylesters may be used as the polycarboxylic acid (PC). The lower alkylesters include, for example, methyl ester, ethyl ester, and isopropyl ester.

There is no particular restriction on a mixture mass ratio (DIC:TC) of the dicarboxylic acid (DIC) to the trivalent or higher polycarboxylic acid (TC) in a mixture of the dicarboxylic acid (DIC) with the trivalent or higher polycarboxylic acid (TC), and the ratio can be appropriately selected, depending on the object. The ratio is preferably, for example, from 100:0.01 to 100:10 and more preferably from 100:0.01 to 100:1.

There is no particular restriction on a mixture ratio in subjecting the polyol (PO) and the polycarboxylic acid (PC) to polycondensation reaction, and any ratio can be appropriately selected, depending on the object. An equivalent ratio ([OH]/[COOH]) of hydroxyl group [OH] in the polyol (PO)

to carboxyl group [COOH] in the polycarboxylic acid (PC) is, for example, preferably from 2/1 to 1/1, more preferably from 1.5/1 to 1/1, and particularly preferably from 1.3/1 to 1.02/1.

There is no particular restriction on a content of the isocyanate group-containing polyester prepolymer (A) in the polyol (PO), and any content can be appropriately selected, depending on the object. The content is preferably, for example, from 0.5% by mass to 40% by mass, more preferably from 1% by mass to 30% by mass, and particularly preferably from 2% by mass to 20% by mass.

Where the content is less than 0.5% by mass, there is a case that the hot offset resistance may be deteriorated, thus making it difficult to attain the heat-resistant storage stability of toner and low-temperature fixing property at the same time. Where the content exceeds 40% by mass, there is a case that the low-temperature fixing property may be deteriorated.

There is no particular restriction on the polyisocyanate (PIC), and any polyisocyanate can be appropriately selected, depending on the object, including, for example, aliphatic polyisocyanate, alicyclic polyisocyanate, aromatic diisocyanate, aromatic aliphatic diisocyanate, isocyanurates, their phenol derivatives, and those blocked with oxime and caprolactam.

The aliphatic polyisocyanate includes, for example, tetramethylene diisocyanate, hexamethylene diisocyanate, 2,6-diisocyanato methylcaproate, octamethylene diisocyanate, decamethylene diisocyanate, dodecamethylene diisocyanate, tetradecamethylene diisocyanate, trimethylhexane diisocyanate, and tetramethylhexane diisocyanate. The alicyclic polyisocyanate includes, for example, isophorone diisocyanate, and cyclohexylmethane diisocyanate. The aromatic diisocyanate includes, for example, tolylene diisocyanate, diphenylmethane, diisocyanate, 1,5-naphthylene diisocyanate, diphenylene-4,4'-diisocyanate, 4,4'-diisocyanato-3,3'-dimethyl diphenyl, 3-methyl diphenyl methane-4,4'-diisocyanate, and diphenyl ether-4,4'-diisocyanate. The aromatic aliphatic diisocyanate includes, for example, α,α,α',α'-tetramethylxylylene diisocyanate. The isocyanurates include, for example, tris-isocyanatoalkyl-isocyanurate, and triisocyanatocycloalkyl-isocyanurate. They may be used solely or in combination.

A mixture ratio for allowing the polyisocyanate (PIC) to react with the active hydrogen group-containing polyester resin (for example, a hydroxyl group-containing polyester resin), that is, a mixture equivalent ratio ([NCO]/[OH]) of isocyanate group [NCO] in the polyisocyanate (PIC) to hydroxyl group [OH] in the hydroxyl group-containing polyester resin is preferably from 5/1 to 1/1, more preferably from 4/1 to 1.2/1, and particularly preferably from 3/1 to 1.5/1. Where the isocyanate group [NCO] exceeds 5, the low-temperature fixing property may be deteriorated. Where it is less than 1, the offset resistance may be deteriorated.

There is no particular restriction on the content of the isocyanate group-containing polyester prepolymer (A) in the polyisocyanate (PIC), and any content can be appropriately selected, depending on the object. The content is preferably, for example, from 0.5% by mass to 40% by mass, more preferably from 1% by mass to 30% by mass, and still more preferably from 2% by mass to 20% by mass. Where the content is less than 0.5% by mass, there is a case that the hot offset resistance may be deteriorated, thus making it difficult to attain the heat-resistant storage stability and the low-temperature fixing property at the same time. Where the content exceeds 40% by mass, there is a case that the low-temperature fixing property may be deteriorated.

The average number of isocyanate groups contained in one molecule of the isocyanate group-containing polyester prepolymer (A) is preferably 1 or more, more preferably from 1.2 to 5 and still more preferably from 1.5 to 4.

Where the average number of the isocyanate groups is less than 1, there is a case that a polyester resin (RMPE) modified by the urea bond-generating group is decreased in molecular weight to deteriorate the hot offset resistance.

The weight average molecular weight (Mw) of a polymer reactive with the active hydrogen group-containing compound is preferably from 1,000 to 30,000 and more preferably from 1,500 to 15,000 as measured using the molecular weight distribution of components soluble in tetrahydrofuran (THF) obtained by GPC (gel permeation chromatography). Where the weight average molecular weight (Mw) is less than 1,000, the heat-resistant storage stability may be deteriorated. Where it exceeds 30,000, the low-temperature fixing property may be deteriorated.

The above molecular weight distribution can be determined by using the gel permeation chromatography (GPC), for example, as follows.

First, a column is equilibrated in a heat chamber kept at 40° C. At this temperature, tetrahydrofuran (THF) as a column solvent is allowed to flow at a flow rate of 1 mL per minute, and a tetrahydrofuran sample solution of resin at which the sample concentration is adjusted to be 0.05 to 0.6% by mass is injected in a quantity of 50 μL to 200 μL to make determination. In determining the molecular weight of the sample, the molecular weight distribution of the sample is calculated by referring to the relationship between the logarithm and the count number of a calibration curve prepared by several types of monodisperse polystyrene standard sample. The standard polystyrene sample for preparing the calibration curve includes those having the molecular weight of $6\times10^2$, $2.1\times10^2$, $4\times10^2$, $1.75\times10^4$, $1.1\times10^5$, $3.9\times10^5$, $8.6\times10^5$, $2\times10^6$ and $4.48\times10^6$ made by Pressure Chemical Co. or Toyo Soda Manufacturing Co., Ltd. At least 10 standard polystyrene samples are preferably used. It is noted that a RI (refractive index) detector can be used as the above-described detector.

--Binder Resin--

There is no particular restriction on the binder resin, and any binder resin can be appropriately selected, depending on the object, including, for example, styrene such as polyester resin, polystyrene, poly-p-chlorostyrene and polyvinyl toluene and a polymer of its substitution product; styrene copolymers such as styrene-p-chlorostyrene copolymer, styrene-propylene copolymer, styrene-vinyl toluene copolymer, styrene-vinyl naphthaline copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-methyl chlormethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer; polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. They may be used solely or in combination. Of these substances, a polyester resin is particularly preferable.

The polyester resin is obtained by condensation polymerization of a carboxylic acid and an alcohol.

The alcohols include, for example, glycols such as ethylene glycol, diethylene glycol, triethylene glycol, propylene glycol; etherified bisphenols such as 1,4-bis(hydroxy methyl) cyclohexane and bisphenol A; other divalent alcohol monomers, and trivalent or higher polyalcohol monomers.

Further, the carboxylic acids include, for example, divalent organic acid monomers such as maleic acid, fumaric acid, phthalic acid, isophthalic acid, terephthalic acid, succinic acid and malonic acid; trivalent or higher multivalent carboxylic acid monomers such as 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylene carboxypropane, and 1,2,7,8-octanetetracarboxylic acid.

-Coloring Agent-

There is no particular restriction on the coloring agent, and any coloring agent can be appropriately selected from any known dyes and pigments, depending on the object, including, for example, carbon black, nigrosin dye, black iron oxide, naphthol yellow S, hansa yellow (10G, 5G, G), cadmium yellow, yellow iron oxide, Chinese yellow, chrome yellow, titan yellow, polyazo yellow, oil yellow, hansa yellow (GR, A, RN, R), pigment yellow L, benzidine yellow (G, GR), permanent yellow (NCG), vulcan fast yellow (5G, R), tartrazine lake, quinoline yellow lake, anthrazane yellow BGL, isoindolinone yellow, red iron oxide, red lead oxide, lead vermilion, cadmium red, cadmium mercury red, antimony red, permanent red 4R, para red, fire red, para-chloro-ortho-nitroaniline red, lithol fast scarlet G, brilliant fast scarlet, brilliant carmine BS, permanent red (F2R, F4R, FRL, FRLL, F4R), fast scarlet VD, vulcan fast rubin B, brilliant scarlet G, lithol rubin GX, permanent red F5R, brilliant carmine 6B, pigment scarlet 3B, Bordeaux 5B, toluidine maroon, permanent Bordeaux F2K, helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanine blue, phthalocyanine blue, fast sky blue, indanthrene blue (RS, BC), indigo, ultramarine blue, iron blue, anthraquinone blue, fast violet B, methyl violet lake, cobalt purple, manganese purple, dioxane violet, anthraquinone violet, chrome green, zinc green, chrome oxide, pyridiane, emerald green, pigment green B, naphthol green B, green gold, acid green lake, malachite green lake, phtharocyanine green, anthraquinone green, titanium oxide, zinc white, and lithopone. They may be used solely or in combination.

There is no particular restriction on the content of the coloring agent in the toner, and any content can be appropriately selected, depending on the object. The content is preferably from 1% by mass to 15% by mass, and more preferably from 3% by mass to 10% by mass. Where the content is less than 1% by mass, the toner may be decreased in coloring power. Where the content exceeds 15% by mass, a pigment may be poorly dispersed in the toner to result in a decrease in coloring power of the pigment and a decrease in electric characteristics of the toner.

The coloring agent may be used as a master batch conjugated with a resin. There is no particular restriction on the resin, and any resin may be appropriately selected from known resins, depending on the object, including, for example, styrene or a polymer of its substitution product, styrene copolymers, polymethyl methacrylate, polybutyl methacrylate, polyvinyl chloride, polyvinyl acetate, polyethylene, polypropylene, polyester, epoxy resin, epoxypolyol resin, polyurethane, polyamide, polyvinyl butyral, polyacrylic acid resin, rosin, modified rosin, terpene resin, aliphatic hydrocarbon resin, alicyclic hydrocarbon resin, aromatic petroleum resin, chlorinated paraffin, and paraffin. They may be used solely or in combination with two or more of them.

The styrene or a polymer of its substituted product includes, for example, polyester resin, polystyrene, poly-p-chlorostyrene, and polyvinyl toluene. The styrene copolymer includes, for example, styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-methyl chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleate copolymer.

The above-described master batch can be manufactured by mixing or kneading a resin for the master batch and the coloring agent at a high shearing force. In this instance, in order to increase interactions between the coloring agent and the resin, it is preferable to add an organic solvent. Further, a so-called flushing method is desirable in that a wet cake of the coloring agent can be used, as it is, to eliminate a subsequent drying. The flushing method is a method in which an aqueous paste which contains water of the coloring agent is mixed or kneaded together with the resin and the organic solvent, by which the coloring agent is transferred to the resin to remove water and components of the organic solvent. The mixing or kneading is conducted by the use of a high-shearing dispersing apparatus such as a three-roll mill.

-Releasing Agent-

There is no particular restriction on the releasing agent, and any releasing agent can be appropriately selected from known agents, depending on the object. For example, waxes can be favorably used.

The waxes include, for example, carbonyl group-containing wax, polyolefin wax, and long-chain hydrocarbon. They may be used solely or in combination. Of these waxes, the carbonyl group-containing wax is preferable.

The carbonyl group-containing wax includes, for example, polyalkanoic acid ester, polyalkanol ester, polyalkanoic acid amide, polyalkyl amide, and dialkyl ketone. The polyalkanic acid ester includes, for example, carnauba wax, montan wax, trimethylolpropane tribehenate, pentaerythritol tetrabehenate, pentaerythritol diacetate dibehenate, glycerin tribehenate, and 1,18-octadecanediol distearate. The polyalkanol ester includes, for example, trimellitic acid tristearyl, and distearyl maleate. The polyalkanoic acid amide includes, for example, dibehenyl amide. The polyalkyl amide includes, for example, trimellitic acid tristearyl amide. The dialkyl ketone includes, for example, distearyl ketone. Of these carbonyl group-containing waxes, polyalkanoic acid ester is particularly preferable.

The polyolefin wax includes, for example, polyethylene wax, and polypropylene wax.

The long-chain hydrocarbon includes, for example, paraffin wax and Southall wax.

There is no particular restriction on the melting point of the releasing agent, and any melting point can be appropriately selected, depending on the object. The melting point is preferably from 40° C. to 160° C., more preferably from 50° C. to 120° C., and particularly preferably from 60° C. to 90° C.

Where the melting point of the releasing agent is less than 40° C., wax may affect the heat-resistant storage stability. Where it exceeds 160° C., cold offset may easily take place on fixing at low temperatures.

The melting viscosity of the releasing agent is preferably from 5 cps to 1,000 cps and more preferably from 10 cps to 100 cps, when measured at a temperature 20° C. higher than the melting point of the wax.

Where the melting viscosity is less than 5 cps, the mold releasability may be decreased. Where it exceeds 1000 cps, there may be provided no effect on improving the hot offset resistance or the low-temperature fixing property.

There is no particular restriction on the content of the releasing agent in the toner, and any content can be appropriately selected, depending on the object. The content is preferably 40% by mass or less, and more preferably from 3% by mass to 30% by mass. Where the content of the releasing agent exceeds 40% by mass, the flowability of toner may be deteriorated.

-Charge Control Agent-

There is no particular restriction on the charge control agent, and any charge control agent can be appropriately selected from known agents, depending on the object. Since the use of colored materials may change the color tone, it is preferable to use a material, which is colorless or close to white. The material includes, for example, triphenylmethane dye, molybdic acid chelate pigment, rhodamine-based dye, alkoxy amine, quaternary ammonium salt (including fluorine-modified quaternary ammonium salt), alkyl amide, a single body of phosphorus or its compound, a single body of tungsten or its compound, fluorine activator, a metal salt of salicylic acid, and a metal salt of salicylic acid derivative. They may be used solely or in combination.

The charge control agent may include a commercially available product. The commercially available product includes, for example, Bontron P-51 (quaternary ammonium salt), E-82 (oxynaphthoic acid metal complex), E-84 (salicylic acid metal complex), and E-89 (phenol condensation product) (all of which are made by Orient Chemical Industries, Ltd.); TP-302 and TP-415 (quaternary ammonium salt/molybdenum complex) (both of which are made by Hodogaya Chemical Co., Ltd.); Copy Charge PSY VP2038 (quaternary ammonium salt), Copy Blue PR (triphenylmethane derivative), Copy Charge NEG VP2036 and Copy Charge NX VP424 (quaternary ammonium salt) (all of which are made by Hoechst); LPA-901, and LR-147 (boron complex) (Japan Carlit Co., Ltd.), quinacridone, azo pigment, and polymeric compounds having another sulfonic acid group, carboxyl group, quaternary ammonium salt.

The charge control agent may be dissolved or dispersed after being melted and kneaded together with the master batch, added directly to the organic solvent together with individual components of the toner on dissolution or dispersion, or fixed to the surface of the toner after manufacture of toner particles.

The content of the charge control agent in the toner is varied, depending on types of the binder resin, the presence or absence of additives and a dispersion method, and cannot be defined in the same manner. The content is preferably, for example, from 0.1 parts by mass to 10 parts by mass with respect to 100 parts by mass of the binder resin, and more preferably from 0.2 parts by mass to 5 parts by mass. Where the content is less than 0.1 parts by mass, there is a case that no electrostatic-charge control may be obtained. Where the content exceeds 10 parts by mass, there is a case that toner may be excessively great in charging property to reduce the effect of a main charge control agent, thus resulting in an increased electrostatic suction force with a developing roller, thereby decreasing the flowability of a developer and the density of an image.

-Other Components-

There is no particular restriction on other components, and any component can be appropriately selected, depending on the object, including, for example, inorganic fine particles, a flowability improver, a cleaning improver, a magnetic material and a metal soap.

There is no particular restriction on the inorganic fine particles, and any fine particle can be appropriately selected from known fine particles, depending on the object, including, for example, silica, alumina, titanium oxide, barium titanate, magnesium titanate, calcium titanate, strontium titanate, zinc oxide, tin oxide, silica sand, clay, mica, wollastonite, diatomaceous earth, chrome oxide, ceric oxide, iron oxide red, antimony trioxide, magnesium oxide, zirconium oxide, barium sulfate, barium carbonate, calcium carbonate, silicon carbide, and silicon nitride. They may be used solely or in combination.

The primary particle diameter of the inorganic fine particles is preferably from 5 nm to 2 μm and more preferably from 5 nm to 500 nm. Further, the specific surface area of the inorganic fine particles obtained by a BET method is preferably from 20 $m^2/g$ to 500 $m^2/g$.

The content of the inorganic fine particles in the toner is preferably from 0.01% by mass to 5.0% by mass, and more preferably from 0.01% by mass to 2.0% by mass.

The flowability improver is that which is increased in hydrophobic property by surface treatment so as to prevent the deterioration in flow characteristics and charge characteristics of toner at high humidity. The improver includes, for example, silane coupling agent, silylation agent, silane coupling agent having a fluorinated alkyl group, organic titanate-based coupling agent, aluminum coupling agent, silicone oil, and modified silicone oil.

The cleaning improver is added to the toner in order to remove a developer remaining in a photoconductor and a primary transfer medium after transfer procedures, including, for example, fatty acid metal salts such as zinc stearate, calcium stearate and stearic acid; and polymer fine particles manufactured by soap-free emulsion polymerization such as polymethyl methacrylate fine particles and polystyrene fine particles. It is preferred that the polymer fine particles are relatively narrow in particle size distribution, with the volume average particle diameter ranging from 0.01 μm to 1 μm.

There is no particular restriction on the magnetic material, and any magnetic material can be appropriately selected from known magnetic materials, depending on the object. The magnetic material includes, for example, iron oxides such as magnetite, hematite and ferrite; metals such as iron, cobalt and nickel; alloys of these metals with aluminum, cobalt, copper, lead, magnesium, tin, zinc, antimony, beryllium, bismuth, cadmium, calcium, manganese, selenium, titanium, tungsten, or vanadium; and their mixtures. Magnetite is particularly preferable in terms of magnetic characteristics.

The above-described ferromagnetic bodies are preferably from 0.1 μm to 2 μm in average particle diameter, contained in toner preferably from 15 parts by mass to 200 parts by mass with respect to 100 parts by mass of the resin component, more preferably from 20 parts by mass to 100 parts by mass.

-Fine Resin Particles-

There is no particular restriction on the fine resin particles, as long as the resin is capable of forming an aqueous dispersion in an aqueous medium. The resin can be appropriately selected from any known resins depending on the object, including thermoplastic resins and thermosetting resins such as vinyl resin, polyurethane resin, epoxy resin, polyester resin, polyamide resin, polyimide resin, silicon resin, phenol resin, melamine resin, urea resin, aniline resin, ionomer resin, and polycarbonate resin. Of these resins, vinyl resin is particularly preferable.

They may be used solely or in combination. Of these resins, it is preferable that the fine resin particles are formed by at least one of those selected from vinyl resin, polyurethane resin, epoxy resin and polyester resin in that an aqueous dispersion of fine spherical particles of resin can be easily obtained.

It is noted that the vinyl resin is a polymer obtained by subjecting vinyl monomer to homopolymerization or copolymerization, including, for example, styrene-(meta)acrylic acid ester resin, styrene-butadiene copolymer, (meta)acrylic acid-acrylic acid ester polymer, styrene-acrylonitrile copolymer, styrene-maleic acid anhydride copolymer, styrene-(meta)acrylic acid copolymer.

Further, a copolymer containing a monomer having at least two unsaturated groups may be used as the above-described fine resin particles.

There is no particular restriction on the monomer having at least two unsaturated groups and any monomer can be appropriately selected, depending on the object, including, for example, sodium salt of methacrylic acid ethylene oxide addition product sulfate ester ("Eleminol RS-30" made by Sanyo Chemical Industries Ltd.), divinyl benzene, 1,6-hexanediol acrylate.

The fine resin particles are obtained by polymerization by a known method appropriately selected, depending on the object. They are preferably obtained as an aqueous dispersion of the fine resin particles. The aqueous dispersion of the fine resin particles is prepared by the following methods, for example, (1) a method in which in the case of the above-described vinyl resin, vinyl monomer is used as a starting material, polymerization reaction is conducted by any method selected from suspension polymerization method, emulsion polymerization method, seed polymerization method and disperse polymerization method to directly manufacture an aqueous dispersion of fine resin particles, (2) a method in which in the case of polyaddition or condensation resins such as the polyester resin, polyurethane resin and epoxy resin, a precursor (monomer, oligomer or others) or the solvent solution thereof is dispersed in an aqueous medium in the presence of an appropriate dispersing agent, and then cured by heating or addition of a curing agent, thereby manufacturing an aqueous dispersion of fine resin particles, (3) a method in which in the case of polyaddition or condensation resins of the polyester resin, polyurethane resin and epoxy resin, an appropriate emulsifying agent is dissolved in a precursor (monomer, oligomer or others) or in the solvent solution thereof (preferably in a liquid, or changed into a liquid by heating), and then water is added to effect the phase inversion emulsification, (4) a method in which a resin previously prepared by polymerization reaction (any type of polymerization reaction is acceptable such as addition polymerization, ring-opening polymerization, polyaddition, addition condensation or condensation polymerization) is pulverized by using a mechanical rotation-type pulverizer or a jet-type pulverizer, and then classified to obtain fine resin particles, which are thereafter dispersed in water in the presence of an appropriate dispersing agent, (5) a method in which a resin previously prepared by polymerization reaction (any type of polymerization reaction is acceptable such as addition polymerization, ring-opening polymerization, polyaddition, addition condensation or condensation polymerization) is dissolved in a solvent to give a resin solution, which is sprayed in a mist form to obtain fine resin particles, thereafter, the fine resin particles are dispersed in water in the presence of an appropriate dispersing agent, (6) a method in which a resin previously prepared by polymerization reaction (any type of polymerization reaction is acceptable such as addition polymerization, ring-opening polymerization, polyaddition, addition condensation or condensation polymerization) is dissolved in a solvent to give a resin solution, to which a poor solvent is added, or a resin solution previously dissolved in a solvent by heating is cooled to precipitate fine resin particles, then, the solvent is removed to obtain resin particles, and thereafter the resin particles are dispersed in water in the presence of an appropriate dispersing agent, (7) a method in which a resin previously prepared by polymerization reaction (any type of polymerization reaction is acceptable such as addition polymerization, ring-opening polymerization, polyaddition, addition condensation, or condensation polymerization) is dissolved in a solvent to give a resin solution, and the resin solution is dispersed in an aqueous medium in the presence of an appropriate dispersing agent, and thereafter the solvent is removed by heating or under reduced pressure, (8) a method in which a resin previously prepared by polymerization reaction (any type of polymerization reaction is acceptable such as addition polymerization, ring-opening polymerization, polyaddition, addition condensation or condensation polymerization) is dissolved in a solvent to give a resin solution, an appropriate emulsifying agent is dissolved in the resin solution, and thereafter water is added to effect the phase inversion emulsification.

The above-described toner includes a toner manufactured by known methods such as a suspension polymerization method, an emulsion aggregation method and an emulsion dispersion method. A preferred toner is prepared by such procedures in which the toner material including an active hydrogen group-containing compound and a polymer reactive with the active hydrogen group-containing compound is dissolved in an organic solvent to prepare a toner solution, thereafter, the toner solution is dispersed in an aqueous medium to prepare a dispersion, the active hydrogen group-containing compound is allowed to react with the polymer reactive with the active hydrogen group-containing compound in the aqueous medium, thereby producing an adhesive base material in particles, and the organic solvent is then removed.

-Toner Solution-

The toner solution can be prepared by dissolving the toner material in the organic solvent.

--Organic Solvent--

There is no particular restriction on the organic solvent, as long as it is a solvent capable of dissolving or dispersing the toner material, and any solvent can be appropriately selected, depending on the object. A volatile solvent is preferably less than 150° C. at the boiling point, for example, in terms of easy removal of the solvent. Preferable are, for example, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. Of these substances, more preferable are toluene, xylene, benzene, methylene chloride, 1,2-dichloroethane, chloroform, carbon tetrachloride, and particularly preferable is ethyl acetate. They may be used solely or in combination.

There is no particular restriction on the usage of the organic solvent, and any usage can be appropriately selected, depending on the object. It is preferably used from 40 parts by mass to 300 parts by mass per 100 parts by mass of the toner material, for example, more preferably from 60 parts by mass to 140 parts by mass, and still more preferably from 80 parts by mass to 120 parts by mass.

--Dispersion--

The dispersion is prepared by dispersing the toner solution in an aqueous medium.

The toner solution is dispersed in the aqueous medium to form a dispersion body (oil droplet) of the toner solution in the aqueous medium.

--Aqueous Medium--

There is no particular restriction on the aqueous medium, and any medium can be appropriately selected from known aqueous media, including, for example, water, a solvent miscible with water, and a mixture thereof. Of these material, water is particularly preferable.

There is no particular restriction on the solvent miscible with water, as long as it is miscible with water, including, for example, alcohol, dimethylformamide, tetrahydrofuran, cellosolves, and lower ketones.

The alcohol includes, for example, methanol, isopropanol, and ethylene glycol. The lower ketones include, for example, acetone and methyl ethyl ketone. They may be used solely or in combination.

It is preferable that the toner solution be dispersed with agitation in the aqueous medium.

There is no particular restriction on the above-described method for dispersion, and any method can be appropriately selected from any known method in which a dispersing device and the like are used. The dispersing device includes, for example, a low-speed shearing-type dispersing device, a high-speed shearing-type dispersing device, a friction-type dispersing device, a high-pressure jet-type dispersing device, and a supersonic dispersing device. Of these devices, in particular preferable is the high-speed shearing-type dispersing device in that the particle diameter of the dispersion body (oil droplet) is controlled in a range from 2 μm to 20 μm.

There is no particular restriction on conditions such as the number of rotations, dispersion time and dispersion temperature when the high-speed shearing-type dispersing device is used, and any condition can be appropriately selected, depending on the object. For example, the number of rotations is preferably from 1,000 rpm to 30,000 rpm, and more preferably from 5,000 rpm to 20,000 rpm. The dispersion time is preferably from 0.1 minutes to 5 minutes for a batch-type device. The dispersion temperature is preferably from 0° C. to 150° C. under pressure, and more preferably from 40° C. to 98° C. It is noted that in general the toner solution can be easily dispersed at elevated temperatures.

The following is an example of toner manufacturing methods in which the adhesive base material is produced in particles to obtain a toner.

In a method for producing the adhesive base material in particles to granulate a toner, for example, the following is conducted, that is, preparation of an aqueous medium phase, preparation of the toner solution, preparation of the dispersion, addition of the aqueous medium and the like (synthesis of a polymer (prepolymer) reactive with the active hydrogen group-containing compound, synthesis of the active hydrogen group-containing compound, and the like).

The aqueous medium phase can be prepared, for example, by dispersing the fine resin particles in the aqueous medium. There is no particular restriction on the content of the fine resin particles added on the aqueous medium, and any content can be appropriately selected, depending on the object. A preferred content is, for example, from 0.5% by mass to 10% by mass.

The toner solution can be prepared by dissolving or dispersing in the organic solvent toner materials such as the active hydrogen group-containing compound, the polymer reactive with the active hydrogen group-containing compound, the coloring agent, the releasing agent, the charge control agent and the unmodified polyester resin.

It is noted that, of the above-described toner materials, components other than the polymer (prepolymer) reactive with the active hydrogen group-containing compound may be added and mixed with the aqueous medium when the fine resin particles are dispersed in the aqueous medium in preparation of the aqueous medium phase, or may be added to the aqueous medium phase, together with the toner solution, when the toner solution is added to the aqueous medium phase.

The dispersion can be prepared by emulsifying or dispersing the previously prepared toner solution in the previously prepared aqueous medium phase. Then, on this emulsification or dispersion, the active hydrogen group-containing compound and the polymer reactive with the active hydrogen group-containing compound are subjected to elongation reaction or cross linking reaction, thereby producing the adhesive base material.

The adhesive base material (for example, the urea modified polyester resin) may be produced, for example, by (1) procedures in which the toner solution, which contains a polymer reactive with the active hydrogen group-containing compound (for example, the isocyanate group-containing polyester prepolymer (A)) is emulsified or dispersed in the aqueous medium phase, together with the active hydrogen group-containing compound (for example, the amines (B)) to form a dispersion body, and they are subjected to elongation reaction or cross linking reaction in the aqueous medium phase, (2) procedures in which the toner solution is emulsified or dispersed in the aqueous medium to which the active hydrogen group-containing compound is added previously, thereby forming a dispersion body, and they are subjected to elongation reaction or cross linking reaction in the aqueous medium phase, or (3) procedures in which the toner solution is added and mixed with the aqueous medium, thereafter, the active hydrogen group-containing compound is added thereto to form a dispersion body, and they are subjected to elongation reaction or cross linking reaction from the particle interface in the aqueous medium phase. It is noted that in the case of the procedures (3), a modified polyester resin is preferentially produced on the surface of the toner to be produced and a concentration gradient is given to the thus produced toner particles.

There is no particular restriction on reaction conditions for producing the adhesive base material by the emulsification or dispersion, and any condition can be appropriately selected, depending on the combination of the polymer reactive with the active hydrogen group-containing compound and the active hydrogen group-containing compound. The reaction time is preferably from 10 minutes to 40 hours, and more preferably from 2 hours to 24 hours. The reaction temperature is preferably from 0° C. to 150° C. and more preferably from 40° C. to 98° C.

The method for stably forming the dispersion body, which contains a polymer reactive with the active hydrogen group-containing compound (for example, the isocyanate group-containing polyester prepolymer (A)) in the aqueous medium phase includes a method in which, for example, toner materials such as a polymer reactive with the active hydrogen group-containing compound (for example, the isocyanate group-containing polyester prepolymer (A)), the coloring agent, the releasing agent, the charge control agent and the unmodified polyester resin are dissolved or dispersed in the organic solvent to prepare the toner solution, which is then added to the aqueous medium phase, and shearing force is employed to disperse the thus added solution. It is noted that details of the method for dispersion are similar to those described above.

In preparing the dispersion, it is preferable to use a dispersing agent, whenever necessary, in view of stabilizing the dispersion body (oil droplets of the toner solution) and narrowing the particle size distribution while ensuring a desired toner shape.

There is no particular restriction on the dispersing agent, and any dispersing agent can be appropriately selected, depending on the object, including, for example, a surfactant, a poor water soluble inorganic compound dispersing agent and a polymeric protective colloid. They may be used solely or in combination with two or more of them. Of these agents, a surfactant is preferable.

The surfactant includes, for example, an anionic surfactant, a cationic surfactant, a nonionic surfactant and an ampholytic surfactant.

The anionic surfactant includes, for example, alkyl benzene sulfonate, α-olefin sulfonate and phosphate ester, and preferable is that having a fluoroalkyl group. The anionic surfactant having a fluoroalkyl group includes, for example, fluoroalkyl carboxylic acids with 2 to 10 carbon atoms or metal salts thereof, disodium perfluorooctane sulfonyl glutamate, sodium 3-[omega-fluoroalkyl (6 to 11 carbon atoms) oxy]-1-alkyl (3 to 4 carbon atoms) sulfonate, sodium 3-[omega-fluoroalkanoyl (6 to 8 carbon atoms)-N-ethylamino]-1-propane sulfonate, fluoroalkyl (11 to 20 carbon atoms) carboxylic acid or its metal salt, perfluoroalkyl carboxylic acid (7 to 13 carbon atoms) or its metal salt, perfluoroalkyl (4 to 12 carbon atoms) sulfonic acid or its metal salt, perfluorooctane sulfonic acid diethanolamide, N-propyl-N-(2-hydroxyethyl) perfluorooctane sulfonamide, perfluoroalkyl (6 to 10 carbon atoms) sulfonamide propyltrimethyl ammonium salt, perfluoroalkyl (6 to 10 carbon atoms)-N-ethyl sulfonyl glycine salt, and monoperfluoroaklyl (6 to 16 carbon atoms) ethylphosphate ester. Commercially available products of the fluoroalkyl group-containing surfactant include, for example, Surfuron S-111, S-112, S-113 (made by Asahi Glass Co., Ltd.); Fluorad FC-93, FC-95, FC-98, FC-129 (made by Sumitomo 3M Limited); Unidine DS-101, DS-102 (made by Daikin Industries Ltd.); Megafac F-110, F-120, F-113, F-191, F-812, F-833 (made by Dainippon Ink and Chemicals, Inc.); Ektop EF-102, 103, 104, 105, 112, 123A, 123B, 306A, 501, 201, 204 (made by Tohkem Products Co., Ltd.); Ftergent F-100, F-150 (made by Neos Co., Ltd.).

The cationic surfactant includes, for example, an amine salt-based surfactant, and a quaternary ammonium salt-based cationic surfactant. The amine salt-based surfactant includes, for example, alkyl amine salt, amino-alcohol fatty acid derivative, polyamine fatty acid derivative and imidazoline. The quaternary ammonium salt-based cationic surfactant includes, for example, alkyl trimethyl ammonium salt, dialkyl dimethyl ammonium salt, alkyl dimethyl benzyl ammonium salt, pyridinium salt, alkyl isoquinolinium salt, and benzetonium chloride. Of the cationic surfactants, preferable are aliphatic quaternary ammonium salts such as aliphatic, primary, secondary or tertiary amine acids having a fluoroalkyl group, perfluoroalkyl (6 to 10 carbon atoms) sulfonamide propyl trimethyl ammonium salt; benzalkonium salt, bezetonium chloride, pyridinium salt, and imidazolinium salt.

Commercially available products of the cationic surfactant include, for example, Surfuron S-121 (made by Asahi Glass Co., Ltd.); Fluorad FC-135 (made by Sumitomo 3M Limited); Unidine DS-202 (made by Daikin Industries Ltd.), Megafac F-150, F-824 (made by Dainippon Ink and Chemicals, Inc.); Ektop EF-132 (made by Tohkem Products Co., Ltd.); Ftergent F-300 (made by Neos Co., Ltd.).

The nonionic surfactant includes, for example, a fatty acid amide derivative and a polyalcohol derivative.

The ampholytic surfactant includes, for example, alanine, dodecyldi(aminoethyl)glycine, di(octylaminoethyl)glycine, and N-alkyl N,N-dimethyl ammonium betaine.

The poor water soluble-inorganic compound dispersing agent includes, for example, tricalcium phosphate, calcium carbonate, titanium oxide, colloidal silica, and hydroxyapatite.

The polymeric protective colloid includes, for example, acids, hydroxyl group-containing (meta)acrylic monomers, vinyl alcohols or ethers with vinyl alcohol, esters of compounds containing vinyl alcohol and carboxyl groups, amide compounds or their methylol compounds, chlorides, homopolymers or copolymers of a nitrogen atom or those having the heterocycle thereof, polyoxyethylenes, and celluloses.

The acids include, for example, acrylic acid, methacrylic acid, α-cyanoacrylic acid, α-cyanomethacrylic acid, itaconic acid, crotonic acid, fumaric acid, maleic acid, and maleic acid anhydride. The hydroxyl group-containing (meta)acrylic monomers include, for example, β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro 2-hydroxypropyl acrylate, 3-chloro-2-hydroxypropyl methacrylate, diethylene glycol monoacrylic acid ester, diethylene glycol monomethacrylic acid ester, glycerin monoacrylic acid ester, glycerin monomethacrylic acid ester, N-methylol acrylamide, and N-methylol methacrylamide. The vinyl alcohols or ethers with vinyl alcohol include, for example, vinyl methyl ether, vinyl ethyl ether and vinyl propyl ether. The esters of compounds containing vinyl alcohol and carboxyl group include, for example, vinyl acetate, vinyl propionate and vinyl butyrate. The amide compounds or their methylol compounds include, for example, acrylamide, methacrylamide, diacetoneacrylamide acid, or their methylol compounds. The chlorides include, for example, acrylic acid chloride and methacrylic acid chloride. The homopolymers or copolymers of a nitrogen atom or those having the heterocycle thereof include, for example, vinyl pyridine, vinyl pyrolidone, vinyl imidazole, and ethylene imine. The polyoxyethylenes include, for example, polyoxyethylene, polyoxypropylene, polyoxyethylene alkylamine, polyoxypropylene alkylamine, polyoxyethylene alkylamide, polyoxypropylene alkylamide, polyoxyethylene nonylphenyl ether, polyoxyethylene lauryl phenyl ether, polyoxyethylene stearyl phenyl ester, and polyoxyethylene nonylphenyl ester. The celluloses include, for example, methyl cellulose, hydroxyethyl cellulose, and hydroxylpropyl cellulose.

In preparing the dispersion, a dispersion stabilizing agent can be used, whenever necessary.

The dispersion stabilizing agent includes, for example, a substance such as calcium phosphate, which is soluble in an acid and an alkali.

Where the dispersion stabilizing agent is used, a method in which calcium phosphate is dissolved with an acid such as hydrochloric acid and washed with water, or an enzymatically decomposing method is employed to remove the calcium phosphate from fine particles.

The dispersion can be prepared by using a catalyst for the elongation reaction or the cross linking reaction. The catalyst includes, for example, dibutyltin laurate and dioctyltin laurate.

An organic solvent is removed from the thus obtained dispersion (emulsified slurry). The organic solvent is removed by (1) a method in which a whole reaction system is gradually heated to completely evaporate and remove the organic solvent contained in the oil droplet, and (2) a method in which an emulsified dispersion body is sprayed in a drying atmosphere to completely remove an insoluble organic solvent contained in the oil droplet, thereby forming fine toner particles, and also evaporating and removing an aqueous dispersing agent.

In removing an organic solvent from an emulsified dispersion, any known storage tank can be used, as long as it is provided with an agitator and a jacket or a heater for heating. With the effective removal of the organic solvent taken into account, it is preferable to use a tank additionally equipped with a decompression facility or that specified so as to feed compressed air, nitrogen and the like.

On removal of the organic solvent, toner particles are formed. The toner particles can be subjected to washing, drying or others and thereafter classified, if so desired. The toner particles can be classified by using, for example, a cyclone, a decanter, or a centrifugation separator to remove fine particles in liquid or may be classified after being obtained in a powder form on drying.

The thus obtained toner particles are mixed with particles of the coloring agent, the releasing agent, the charge control agent and the like or a mechanical impact force is also applied, thus making it possible to prevent particles of the releasing agent and the like from being detached from the surface of the toner particles.

The method for applying the mechanical impact force includes a method for applying an impact force to a mixture, for example, by using a blade rotating at a high speed and a method in which a mixture is fed into a high-speed air current and accelerated, by which particles are allowed to collide with other particles or complicated particles are allowed to collide against an appropriate board. Devices used in the methods include, for example, Ong mill (made by Hosokawa Micron Corporation), a modified device of I-type mill (made by Nippon Pneumatic Mfg. Co., Ltd.) at which an air pressure for pulverization is reduced, Hybridization system (made by Nara Machinery Co., Ltd.), Criptron system (made by Kawasaki Heavy Industries Inc.), and an automatic mortar.

It is preferable that the toner has the following volume average particle diameter (Dv), volume average particle diameter (Dv)/number average particle diameter (Dn), and average circularity.

The volume average particle diameter (Dv) of the toner is preferably, for example, from 3 μm to 7 μm, more preferably from 4 μm to 7 μm, and still more preferably from 5 μm to 6 μm. In this instance, the volume average particle diameter is defined to be $Dv=[(\Sigma(nD^3)/\Sigma n)^{1/3}$ (in the formula, n denotes the number of particles, and D denotes particle diameter).

Where the volume average particle diameter is less than 3 μm, there is a case that when a two-component developer is agitated for a long time by a developing apparatus, toner may be fused on the surface of a carrier to reduce the charging ability of the carrier. Further, in the case of a one-component developer, toner filming onto a developing roller or toner fusing on members such as a blade, resulting from the toner formed into a thin layer, may easily occur. Where the volume average particle diameter exceeds 7 μm, it is difficult to obtain a high-quality image at a high resolution. Where the toner is consumed or replenished, it may result in a great change in the toner particle diameter.

The ratio (Dv/Dn) of the volume average particle diameter (Dv) to the number average particle diameter (Dn) in the toner is preferably, for example, 1.25 or lower, more preferably from 1.00 to 1.20, and still more preferably from 1.10 to 1.20.

Where the ratio (Dv/Dn) of the volume average particle diameter to the number average particle diameter is 1.25 or lower, the toner is relatively narrow in particle size distribution and the fixing property is improved. Where the ratio is less than 1.00, in a two-component developer agitated for a long time by a developing apparatus, the toner is fused on the surface of a carrier, and the carrier may be decreased in charging ability or deteriorated in cleaning performance. Further, in a one-component developer, toner filming onto a developing roller or toner fusing on members such as a blade, resulting from the toner formed into a thin layer, may easily occur. Where the ratio exceeds 1.20, it is difficult to obtain a high-quality image at a high resolution. Where toner is consumed or replenished, it may result in a great change in the toner particle diameter.

The volume average particle diameter and the ratio (Dv/Dn) of the volume average particle diameter to the number average particle diameter can be determined by using, for example, a grind meter, "Multisizer II" made by Beckman Coulter Inc.

The average circularity is a value obtained by dividing the circumferential length of a circle having the same area as a projection of a real particle by the circumferential length of the real particle, and is preferably for example, from 0.94 to 0.99 and more preferably from 0.950 to 0.98. It is noted that particles, the average circularity of which is less than 0.94, are preferably 15% or lower.

Where the average circularity is less than 0.94, it may be impossible to obtain a satisfactory transfer property or a dust-free high quality image. Where it exceeds 0.99, in an image forming system equipped with a cleaning blade, there is found poor cleaning on a photoconductor or a transfer belt to result in a blemished image. For example, in the formation of an image greater in image area rate such as a photographic image, a toner, which has formed an untransferred image due to a failure in feeding paper, may result in scumming of the image because the toner accumulates on a photoconductor as a remaining toner. Alternatively, the toner may contaminate a charging roller and the like which are in contact with a photoconductor to cause a charge, thereby resulting in a failure in exhibiting an original charging ability.

The average circularity can be measured by an optical detection zone method in which, for example, a suspension containing toner is allowed to pass through an imaging detection zone on a flat board, and a CCD camera is used to optically detect a particle image and make analysis. It can be measured by using, for example, a flow-type particle image analyzer FPIA-2100 (Sysmex Corporation).

<Developer>

The developer used in the present invention contains at least the toner of the present invention and also has other components such as a carrier appropriately selected. The developer may be either a one-component developer or a two-component developer. When used in a high-speed printer to cope with the improvement in information processing speed in recent years, the two-component developer is preferable in terms of an extended service life.

In the one-component developer in which the toner of the present invention is used, the particle diameter of the toner is varied to a lesser extent after the toner is consumed or replenished, and there is no toner filming onto a developing roller nor toner fusing on members such as a blade resulting from the toner formed into a thin layer. When the one-component developer is used (agitated) for a long time by a developing apparatus, favorable and stable developing properties and images are provided. Further, in the two-component developer in which the toner of the present invention is used, the diameter of the toner contained in the developer is changed to a lesser extent after long term toner consumption and replenishment. There are also provided favorable and stable developing properties upon a prolonged agitation by the developing apparatus.

-Carrier-

There is no particular restriction on the carrier, and any carrier can be appropriately selected, depending on the object. It is, however, preferable that the carrier has a core and a resin layer for coating the core.

There is no particular restriction on the material of the core, and any material can be appropriately selected from known materials. Preferable are, for example, a manganese-strontium (Mn-Sr) based material with 50 emu/g to 90 emu/g and a manganese-magnesium (Mn-Mg) based material with the same value. In terms of securing the image density, preferable are highly magnetized materials such as iron powder (100 emu/g or more) and magnetite (75 emu/g to 120 emu/g). Further, in terms of being advantageous in attaining a high quality image by weakening the collision of toner against a photoconductor at which the toner is raised, preferable are weakly magnetized materials such as a copper-zinc (Cu-Zu) based material (30 emu/g to 80 emu/g). They may be used solely or in combination.

The particle diameter of the core is preferably from 10 μm to 150 μm on the basis of the volume average particle diameter, and more preferably from 40 μm to 100 μm.

Where the average particle diameter (volume average particle diameter ($D_{50}$)) is less than 10 μm, there is a case that fine powders may be increased in distribution of carrier particles to decrease the magnetization per particle, thereby causing carrier scattering. Where the average particle diameter exceeds 150 μm, the specific surface area may be decreased to cause toner scattering, and in full-color printing with a greater solid part, the solid part in particular may be poorly reproduced.

There is no particular restriction on the material of the resin layer, and any resin can be appropriately selected from known resins, depending on the object. The resin includes, for example, amino resin, polyvinyl resin, polystyrene resin, halogenated olefin resin, polyester resin, polycarbonate resin, polyethylene resin, polyvinyl fluoride resin, polyvinylidene fluoride resin, polytrifluoro ethylene resin, polyhexafluoropropylene resin, copolymer of vinylidene fluoride with acryl monomer, copolymer of vinylidene fluoride with vinyl fluoride, fluoro terpolymers such as terpolymers of non-fluorinated monomer with tetrafluoro ethylene and vinylidene fluoride and, and silicone resin. They may be used solely or in combination with two or more of them.

The amino resin includes, for example, urea-formaldehyde resin, melamine resin, benzoguanamine resin, urea resin, polyamide resin and epoxy resin. The polyvinyl resin includes, for example, acryl resin, polymethyl methacrylate resin, polyacrylonitrile resin, polyvinyl acetate resin, polyvinyl alcohol resin, and polyvinyl butyral resin. The polystyrene resin includes, for example, polystyrene resin, and styrene-acryl copolymerization resin. The halogenated olefin resin includes, for example, polyvinyl chloride. The polyester resin includes, for example, polyethylene terephthalate resin and polybutylene terephthalate resin.

The resin layer may include a conductive powder and the like, whenever necessary. The conductive powder includes, for example, metal powder, carbon black, titanium oxide, tin oxide, and zinc oxide. The average particle diameter of the conductive powder is preferably 1 μm or lower. Where the average particle diameter exceeds 1 μm, it may be difficult to control the electric resistance.

The resin layer can be formed by procedures in which, for example, the silicone resin or the like is dissolved in a solvent to prepare a coating solution, thereafter, the coating solution is coated uniformly on the surface of the core by a known coating method, the resultant is dried and printed. The coating method includes, for example, a dipping method, spray method, and brush coating method.

There is no particular restriction on the solvent, and any solvent can be appropriately selected, depending on the object. The solvent includes, for example, toluene, xylene, methyl ethyl ketone, methyl isobutyl ketone, cellosolve, and butylacetate.

There is no particular restriction on the printing, and printing by external heating or that by internal heating will do. The printing can be conducted, for example, by a method of using a stationary-type electric furnace, a fluid-type electric furnace, a rotary electric furnace, a burner or the like, or by a method of applying a microwave.

The content of the carrier in the resin layer is preferably from 0.01% by mass to 5.0% by mass. Where the content is less than 0.01% by mass, it may be impossible to form the resin layer uniformly on the surface of the core. Where the content exceeds 5.0% by mass, the resin layer may be made excessively thick to granulate between carriers, thus resulting in a failure in obtaining uniform carrier particles.

Where the developer is the two-component developer, there is no particular restriction on the content of the carrier in the two-component developer, and any content can be appropriately selected, depending on the object. The content is preferably, for example, from 90% by mass to 98% by mass, and more preferably from 93% by mass to 97% by mass.

Since the developer contains the toner of the present invention, it is possible to form stably a high quality image excellent in charging performance on formation of the image.

The developer is favorably usable in forming an image by various types of known electrophotography such as a magnetic single-component developing method, a non-magnetic single-component developing method, and a two-component developing method. Further, the developer is particularly preferably usable in the toner container, process cartridge, image forming apparatus and image forming method of the present invention, which will be described as follows.

<Toner Container>

The toner container used in the present invention contains therein the toner or developer of the present invention.

There is no particular restriction on the toner container, and any container can be appropriately selected from known containers. A preferred container includes, for example, a toner container with the body and the cap.

There is no particular restriction on the toner container body with respect to the dimension, shape, structure and type of material, and any condition can be appropriately selected depending on the object. For example, regarding the shape, preferable is a cylindrical shape, and particularly preferable is that in which spiral irregularities are formed on the inner circumferential surface, toner contained therein can be moved to a discharge port by rotation and also the spiral part is partially or entirely provided with cornice functions.

There is no particular restriction on the type of material of the toner container body. A preferred material is that with a high dimensional accuracy, for example, resins. Of these resins, preferable are, for example, polyester resin, polyethylene resin, polypropylene resin, polystyrene resin, polyvinyl chloride resin, polyacrylic acid, polycarbonate resin, ABS resin, and polyacetal resin.

The toner container is easy in storage, transportation and the like, excellent in handling, and favorably used in filling toner by attaching in a removable manner to the process cartridge and the image forming apparatus, which will be described later.

<Process Cartridge>

The process cartridge used in the present invention is provided with at least a latent electrostatic image bearing member for bearing thereon a latent electrostatic image and a developing unit configured to develop the latent electrostatic image on the latent electrostatic image bearing member by using a developer, thereby forming a visible image, and additionally provided with other units selected appropriately, if necessary.

The developing unit is provided with at least a developer container for accommodating the toner or developer of the present invention and a developer bearing member for bearing and transporting the toner or developer accommodated in the developer container, and may be additionally provided with a layer-thickness regulating member or the like for regulating the thickness of the toner layer to be carried and supported.

The process cartridge detachably mounted to various types of image forming apparatuses, facsimile machines and printing machines, and preferably installed in a removable manner on the image forming apparatus of the present invention, which will be described later.

In this instance, the process cartridge has a built-in latent electrostatic image bearing member 101, for example, shown in FIG. 1, includes a charging unit 102, a developing unit 104, a transfer unit 108 and a cleaning unit 107, and also has other units, if necessary. In FIG. 1, the numerals 103 and 105 respectively denote exposure by an exposure unit and a recording medium.

Next, a description will be given of an image forming process by the process cartridge shown in FIG. 1. The latent electrostatic image bearing member 101 is rotated in a direction given by the arrow to form a latent electrostatic image corresponding to an exposure image on the surface thereof by charge by the charging unit 102 and exposure 103 by the exposure unit (not shown). The latent electrostatic image is developed by the developing unit 104, and the thus obtained visible image is transferred to the recording medium 105 by a transfer unit 108, and printed out. Then, the surface of the latent electrostatic image bearing member after the image transfer is cleaned by the cleaning unit 107 and also eliminated for charge by the charge eliminating unit (not shown). Then, the above procedures are repeated.

(Image Forming Method and Image Forming Apparatus)

The image forming method of the present invention includes at least a latent electrostatic image forming step, a developing step, a transfer step and a fixing step, and also includes other steps appropriately selected whenever necessary, for example, a charge eliminating step, a cleaning step, a recycle step and a control step.

The image forming apparatus of the present invention is provided with at least a latent electrostatic image bearing member, a latent electrostatic image forming unit, a developing unit, a transfer unit and fixing unit, and also provided with other units appropriately selected whenever necessary, for example, an charge eliminating unit, a cleaning unit, a recycle unit and a control unit.

The latent electrostatic image forming step is a step of forming a latent electrostatic image on a latent electrostatic image bearing member.

There is no particular restriction on the latent electrostatic image bearing member (hereinafter sometimes referred to as "electrophotograph photoconductor" or "photoconductor") with respect to the material, shape, structure, dimension and the like. Any latent electrostatic image bearing member can be appropriately selected from known bearing members. The shape preferably includes a drum shape. The material includes, for example, inorganic photoconductors such as amorphous silicon and selenium; organic photoconductors such as polysilane and phthalopolymethine. Of these substances, amorphous silicon and the like are preferable in terms of a long service life.

The latent electrostatic image can be formed, for example, by exposure according to an image after the surface of the latent electrostatic image bearing member is uniformly charged. The image can be formed by the latent electrostatic image forming unit. The latent electrostatic image forming unit is provided with, at least for example, an electrifier for uniformly charging the surface of the latent electrostatic image bearing member and an exposure device for exposing the surface of the latent electrostatic image bearing member according to an image.

The charging can be conducted, for example, by using the electrifier to apply voltage to the surface of the latent electrostatic image bearing member.

There is no particular restriction on the electrifier, and any electrifier can be appropriately selected, depending on the object, including, for example, a contact electrifier that is self-explanatory, which is provided with a conductive or semi-conductive roll, a brush, a film, a rubber blade or the like, and a non-contact electrifier by utilizing corona discharge such as corotron and scorotron.

The exposure can be conducted, for example, by using the exposure device to expose the surface of the latent electrostatic image bearing member according to an image.

There is no particular restriction on the exposure device, as long as it is able to conduct exposure on the surface of the latent electrostatic image bearing member charged by the electrifier according to an image to be formed. Any exposure device can be appropriately selected, depending on the object, including, for example, various types of exposure devices based on a reproduction optical system, a rod lens array system, a laser optical system, and a liquid crystal shutter optical system.

It is noted that the present invention may adopt a back-exposure method in which the exposure is conducted according to an image from the back face of the latent electrostatic image bearing member.

--Developing Step and Developing Unit--

The developing step is a step in which the latent electrostatic image is developed by using the toner or the developer of the present invention, thereby forming a visible image.

The visible image can be formed, for example, by using the toner or the developer of the present invention to develop the latent electrostatic image. The image can be formed by the developing unit.

There is no particular restriction on the developing unit, as long as an image can be developed by using, for example, the toner or the developer of the present invention. Any developing unit can be appropriately selected from known units. Preferable is, for example, a developing unit, which accommodates the toner or the developer of the present invention and has at least a developing device capable of imparting the toner or the developer to a latent electrostatic image in contact therewith or without contact. More preferable is a developing device provided with the toner container.

The developing device may include a dry-type developing device, a wet-type developing device, a single-color developing device and a multi-color developing device. Preferable is, for example, a device provided with an agitator of agitating frictionally the toner or the developer to effect charging and a rotatable magnet roller.

Inside the developing device, for example, the toner and the carrier are mixed and agitated, and the toner is charged by the resulting friction and kept raised on the surface of the rotating magnet roller, thereby forming a magnetic brush. Since the magnet roller is arranged in the vicinity of the latent electrostatic image bearing member (photoconductor), the toner constituting the magnetic brush formed on the surface of the magnet roller is partially moved to the surface of the latent electrostatic image bearing member (photoconductor) due to an electrical suction force. As a result, the latent electrostatic image is developed by the toner and a visible image is formed on the surface of the latent electrostatic image bearing member (photoconductor) by the toner.

The developer accommodated in the developing device is a developer which contains the toner of the present invention. The developer may be a one-component developer or a two-component developer. The toner contained in the developer is the toner of the present invention.

-Transfer Step and Transfer Unit-

The transfer step is a step of transferring the visible image to a recording medium. Preferable is an aspect in which an intermediate transfer member is used to primarily transfer a visible image onto the intermediate transfer member, thereafter, the visible image is secondarily transferred onto the recording medium. More preferable is an aspect including a primary transfer step in which two or more color toners or, preferably, a full color toner is used as the toner to transfer a visible image onto the intermediate transfer member, thereby forming a complicated transfer image and a secondary transfer step in which the complicated transfer image is transferred onto a recording medium.

The transfer can be conducted, for example, by using a transfer electrifier to charge the visible image on the latent electrostatic image bearing member (photoconductor). The transfer can be conducted by the transfer unit. It is preferable that the transfer unit is of an aspect including a primary transfer unit in which a visible image is transferred onto an intermediate transfer member to form a complicated transfer image and a secondary transfer unit in which the complicated transfer image is transferred onto a recording medium.

It is noted that there is no particular restriction on the intermediate transfer member, and any transfer member can be appropriately selected from known transfer members, depending on the object. Preferable is, for example, a transfer belt or the like.

It is preferable that the transfer units (the primary transfer unit and the secondary transfer unit) are provided with at least a transfer device for peeling and charging the visible image formed on the latent electrostatic image bearing member (photoconductor) to the recording medium. The transfer unit may be provided in one unit or two or more units.

The transfer device includes a corona transfer device based on corona discharge, a transfer belt, a transfer roller, pressure transfer roller, and an adhesive transfer device.

It is noted that there is no particular restriction on the recording medium, and any recording medium can be appropriately selected from known recording media (recording paper).

The fixing step is a step in which a visible image transferred to a recording medium is fixed by using a fixing device. This step may be carried out for every transfer of individual color toners to the recording medium or carried out once at the same time for the individual color toners in a state that they are stacked.

There is no particular restriction on the fixing device, and any fixing device can be appropriately selected, depending on the object. Preferable is a known heating/pressure unit. The heating/pressure unit includes a combination of a heating roller with a pressure roller and a combination of a heating roller, a pressure roller and an endless belt.

Preferable heating by the heating/pressure unit is usually from 80° C. to 200° C.

It is noted that, for example, any known optical fixing device may be used in the fixing step, together with a fixing unit or in place of the fixing unit, depending on the object in the present invention.

The charge eliminating step is a step of applying a charge eliminating bias to the latent electrostatic image bearing member to eliminate charges, and can be favorably conducted by the charge eliminating unit.

There is no particular restriction on the charge eliminating unit, as long as it is able to apply an antistatic bias to the latent electrostatic image bearing member. Any unit can be appropriately selected from known charge eliminating devices, including, for example, a charge eliminating lamp.

The cleaning step is a step of removing the toner remaining on the latent electrostatic image bearing member and can be conducted favorably by a cleaning unit.

There is no particular restriction on the cleaning unit, as long as it is able to remove the electrophotographic toner remaining on the latent electrostatic image bearing member. The cleaning unit can be appropriately selected from known cleaners. Preferable are, for example, a magnetic brush cleaner, electrostatic brush cleaner, a magnetic roller cleaner, a blade cleaner, a brush cleaner and a web cleaner.

The recycle step is a step in which the toner removed by the cleaning step is recycled back to the developing unit. This step can be favorably conducted by the recycle unit.

There is no particular restriction on the recycle unit, including a known transfer unit.

The control step is a step of controlling the above-described individual steps and can be favorably conducted by the control unit.

There is no particular restriction on the control unit, as long as it is able to control actions of the individual steps. Any control unit can be appropriately selected, depending on the object, including, for example, devices such as a sequencer and a computer.

Figure 2:
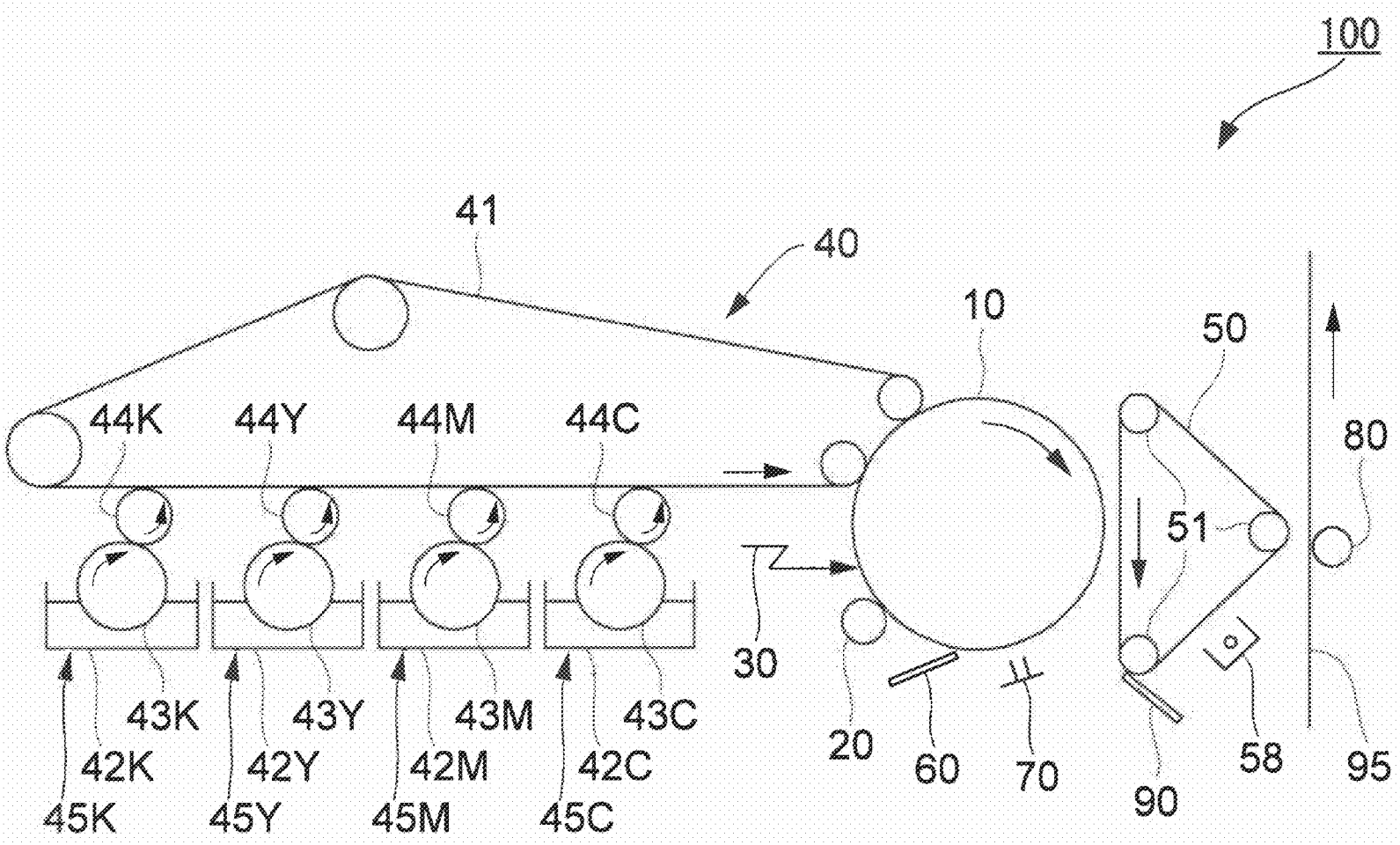
FIG. 2 is a schematic explanatory view showing an example of an image forming apparatus used in the image forming method of the present invention.

A description will be given of one aspect of carrying out the image forming method of the present invention by the image forming apparatus with reference to FIG. 2. As shown in FIG. 2, an image forming apparatus 100 is provided with a photoconductor drum 10 (hereinafter referred to as "photoconductor 10") as the latent electrostatic image bearing member, a charging roller 20 as the charging unit, an exposure device 30 as the exposure unit, a developing apparatus 40 as the developing unit, an intermediate transfer member 50, a cleaning device 60 as the cleaning unit equipped with a cleaning blade, and a charge eliminating lamp 70 as the charge eliminating unit.

An intermediate transfer member 50 is an endless belt and designed so as to be moved in the direction given by the arrow in the drawing by three rollers 51 arranged thereinside to stretch the belt. Some of the three rollers 51 also function as a transfer bias roller capable of applying a predetermined transfer bias (primary transfer bias) to the intermediate transfer member 50. A cleaning blade 90 for the intermediate transfer member is arranged in the vicinity of the intermediate transfer member 50. A transfer roller 80 as the transfer unit capable of applying a transfer bias for transferring (secondary transfer) a visible image (toner image) to a recording medium 95 is also arranged so as to oppose thereto. A corona electrifier 58 for charging a visible image on the intermediate transfer member 50 is arranged around the intermediate transfer member 50 in a direction in which the intermediate transfer member 50 rotates, that is, between a site at which the latent electrostatic image bearing member 10 is in contact with the intermediate transfer member 50 and a site at which the intermediate transfer member 50 is in contact with the recording medium 95.

The developing apparatus 40 is constituted with a developing belt 41 as a developer bearing member, a black developing unit 45K, a yellow developing unit 45Y, a magenta developing unit 45M and a cyan developing unit 45C installed adjacent to the developing belt 41. It is noted that the black developing unit 45K is provided with a developer accommodating portion 42K, a developer supplying roller 43K and a developing roller 44K. The yellow developing unit 45Y is provided with a developer accommodating portion 42Y, a developer supplying roller 43Y, and a developing roller 44Y. The magenta developing unit 45M is provided with a developer accommodating portion 42M, a developer supplying roller 43M and a developing roller 44M. The cyan developing unit 45C is provided with a developer accommodating portion 42C, a developer supplying roller 43C and a developing roller 44C. Further, the developing belt 41 is an endless belt and stretched by a plurality of belt rollers so as to be rotated, a part of which is in contact with the latent electrostatic image bearing member 10.

In the image forming apparatus 100 shown in FIG. 2, for example, a charging roller 20 uniformly charges a photoconductor drum 10. Exposure according to an image is conducted on the photosensitive drum 10 by an exposure device 30 to form a latent electrostatic image. The latent electrostatic image formed on the photosensitive drum 10 is developed by supplying toner from a developing apparatus 40 to form a visible image (toner image). The visible image (toner image) is transferred (primary transfer) onto an intermediate transfer member 50 by voltage applied from a roller 51 and further transferred (secondary transfer) onto transfer paper 95. As a result, the visible image is formed on the transfer paper 95. It is noted that the toner remaining on the photoconductor 10 is removed by a cleaning device 60 and the photoconductor 10 is once eliminated for charge by a charge eliminating lamp 70.

Figure 3:
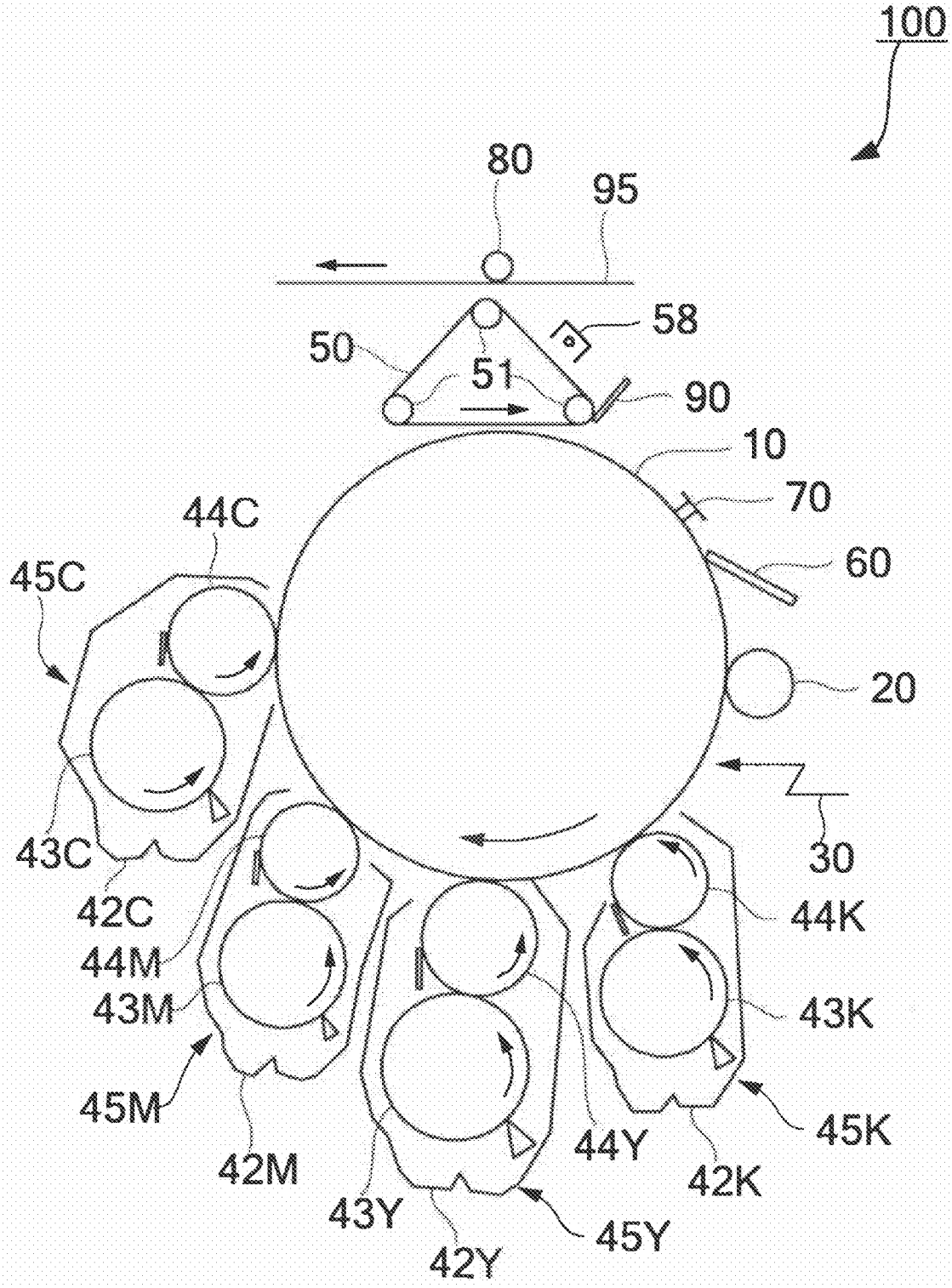
FIG. 3 is a schematic explanatory view showing another example of the image forming apparatus used in the image forming method of the present invention.

A description will be given of another aspect of carrying out the image forming method of the present invention by the image forming apparatus with reference to FIG. 3. The image forming apparatus 100 shown in FIG. 3 is free of the developing belt 41 of the image forming apparatus 100 shown in FIG. 2 and constituted similarly as with the image forming apparatus 100 shown in FIG. 2, with the similar actions and effects obtained, except that the black developing unit 45K, the yellow developing unit 45Y, the magenta developing unit 45M and the cyan developing unit 45C are arranged around the photoconductor 10 so as to oppose directly. It is noted that the same components of FIG. 3 as those of FIG. 2 are given the same symbols or numerals.

Figure 4:
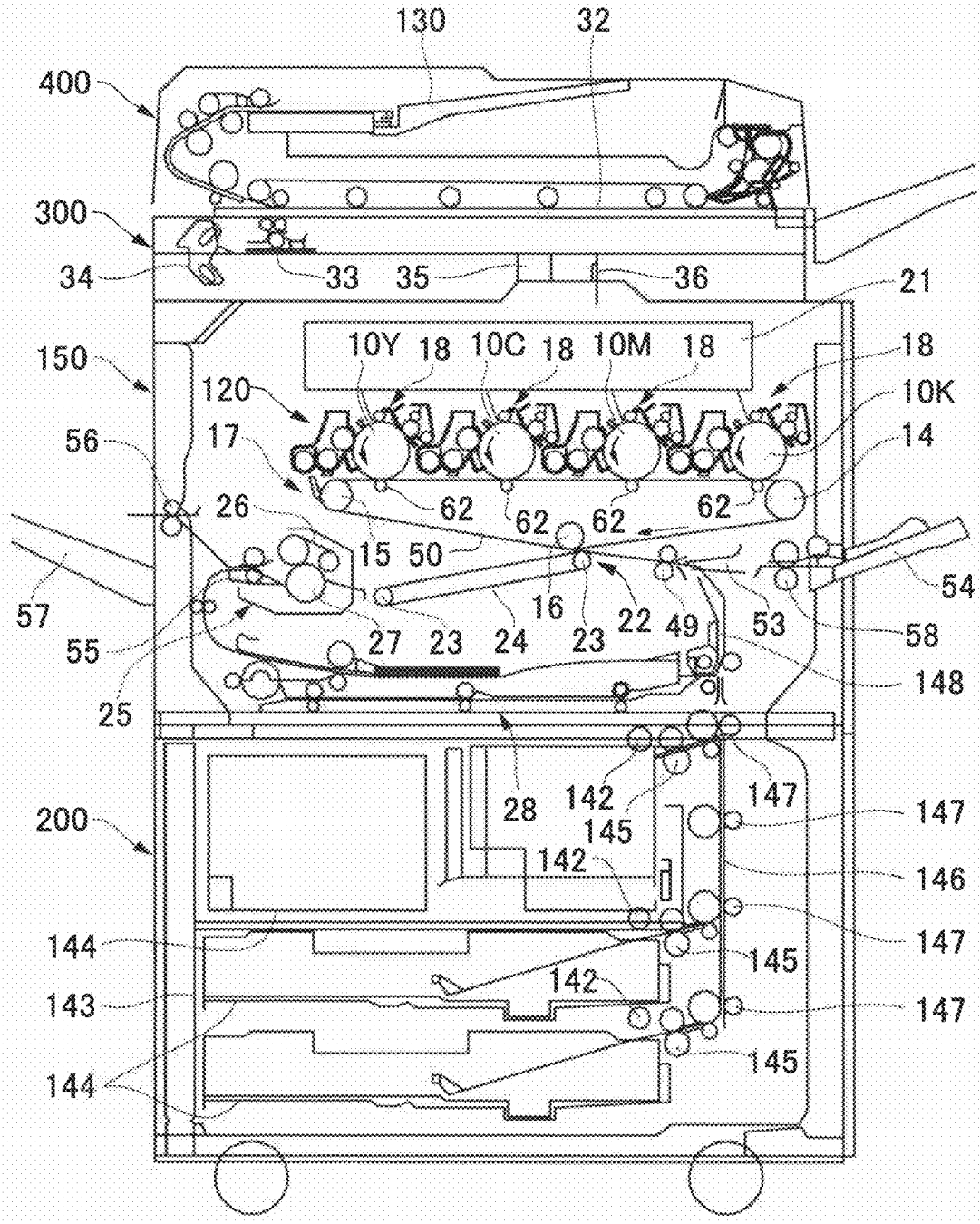
FIG. 4 is a schematic explanatory view showing an example of the image forming apparatus (tandem-type color image forming apparatus) used in the image forming method of the present invention.

A description will be given of still another aspect of carrying out the image forming method of the present invention by the image forming apparatus with reference to FIG. 4. The tandem image forming apparatus shown in FIG. 4 is a tandem-type color image forming apparatus. The tandem image forming apparatus is provided with a reproducing apparatus main body 150, a sheet feeding table 200, a scanner 300 and an automatic document feeder (ADF) 400.

The reproducing apparatus main body 150 is provided with an endless-belt type intermediate transfer member 50 at the center. Then, the intermediate transfer member 50 is stretched by supporting rollers 14, 15, and 16 so as to be rotated in a clockwise direction as shown in FIG. 4. An intermediate transfer member cleaning device 17 for removing toner remaining on the intermediate transfer member 50 is arranged in the vicinity of the supporting roller 15. On the intermediate transfer member 50 stretched by the supporting roller 14 and the supporting roller 15, a tandem-type developing device 120 is arranged in its conveying direction in which four image forming units 18 (yellow, cyan, magenta and black) are arranged side by side so as to oppose the intermediate transfer member 50. An exposure device 21 is arranged in the vicinity of the tandem-type developing device 120. A secondary transfer device 22 is arranged on a side opposite to the side at which the tandem-type developing device 120 is arranged on the intermediate transfer member 50. In the secondary transfer device 22, the secondary transfer belt 24, which is an endless belt, is stretched around a pair of rollers 23. Transfer paper conveyed on the secondary transfer belt 24 and the intermediate transfer member 50 are in contact with each other. A fixing device 25 is arranged in the vicinity of the secondary transfer device 22. The fixing device 25 is provided with a fixing belt 26, which is an endless belt, and a pressure roller 27 arranged so as to be pressed thereby.

It is noted that a sheet reversing device 28 for inverting the transfer paper to form an image on both faces of the transfer paper is arranged in the vicinity of the secondary transfer device and the fixing device 25 of the tandem image forming apparatus.

Next, a description will be given of a full-color image formation (color copy) by using the tandem-type developing device 120. In other words, first, documents are set on the document counter 130 of the automatic document feeder (ADF), or the automatic document feeder 400 is opened to set documents on the contact glass 32 of the scanner 300 and the automatic document feeder 400 is closed.

Depression of a start switch (not shown) will actuate a scanner 300 after documents are conveyed and moved to a contact glass 32 when the documents are set on the automatic document feeder 400, whereas actuating the scanner immediately when the documents are set on the contact glass 32 allows a first traveling body 33 and a second traveling body 34 to travel. In this instance, light from a light source is radiated from the first traveling body 33 and also light reflected from the surface of the documents is reflected on a mirror of the second traveling body 34, and received by a reading sensor 36 through an imaging lens 35, by which color documents (color images) are read to give image information of black, yellow, magenta and cyan.

Figure 5:
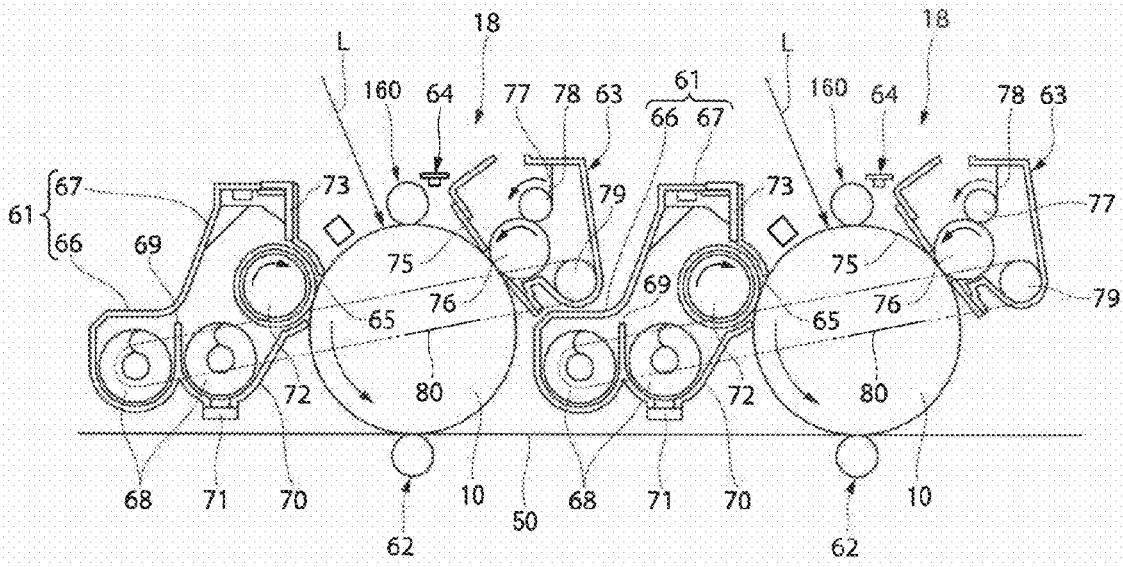
FIG. 5 is a partially-enlarged schematic explanatory view for the image forming apparatus of FIG. 4.

Then, image information of black, yellow, magenta and cyan is sent to each of the image forming units 18 (black image forming unit, yellow image forming unit, magenta image forming unit and cyan image forming unit) in the tandem-type developing unit 120, thereby forming toner images of black, yellow, magenta and cyan by each of the image forming units. In other words, as shown in FIG. 5, the image forming units 18 (black image forming unit, yellow image forming unit, magenta image forming unit and cyan image forming unit) in the tandem-type developing unit 120 are respectively provided with latent electrostatic image bearing members 10 (black latent electrostatic image bearing member 10K, yellow latent electrostatic image bearing member 10Y, magenta latent electrostatic image bearing member 10M and cyan latent electrostatic image bearing member 10C), an electrification device 160 for uniformly charging the latent electrostatic image bearing members 10, an exposure device for exposing the latent electrostatic image bearing member according to an image corresponding to each of color images on the basis of each color image information (L given in FIG. 5) to form a latent electrostatic image corresponding to each color image on the latent electrostatic image bearing member, a developing device 61 for developing the latent electrostatic image by using each color toner (black toner, yellow toner, magenta toner and cyan toner) to form a toner image by each color toner, a transfer electrifier 62 for transferring the toner image onto the intermediate transfer member 50, a cleaning device 63 and an antistatic device 64. Each of the single-color images (black image, yellow image, magenta image and cyan image) can be formed on the basis of the respective color image information. The thus formed black image, the yellow image, the magenta image and the cyan image are sequentially transferred (primary transfer) onto the intermediate transfer member 50 rotated and moved by the supporting rollers 14, 15, and 16, respectively as a black image formed on the black latent electrostatic image bearing member 10K, a yellow image formed on the yellow latent electrostatic image bearing member 10Y, a magenta image formed on the magenta latent electrostatic image bearing member 10M, and a cyan image formed on the cya latent electrostatic image bearing member 10C. Then, the black image, the yellow image, the magenta image, and the cyan image are superimposed on the intermediate transfer member 50, thereby forming a synthesized color image (color transfer image).

In the sheet feeding table 200, one of the sheet feeding rollers 142 is selectively rotated to deliver sheets (recording paper) from one of the sheet feeding cassettes 144 provided in a multi-stage manner on a paper bank 143. The thus delivered sheets are separated one by one by a separation roller 145 and sent to a sheet feeding path 146. Then, the sheets are conveyed by a conveying roller 147 and guided into a sheet feeding path 148 inside a copier main body 150 and stopped by hitting them against a resist roller 49. Alternatively, the sheet feeding roller 142 is rotated to deliver sheets (recording paper) on a manual tray 54. The thus delivered sheets are separated one by one by the separation roller 145 and placed into a manual sheet feeding path 53 and stopped in a similar manner by hitting them against the resist roller 49. It is noted that the resist roller 49 is in general grounded before use, but in this instance, the roller may be used, with bias being applied, in view of removing dust on the sheets. Then, the resist roller 49 is rotated in synchronization with a synthesized color image (color transfer image) synthesized on an intermediate transfer member 50, by which the sheets (recording paper) are sent between the intermediate transfer member 50 and a secondary transfer device 22. The synthesized color image (color transfer image) is transferred (secondary transfer) onto the sheets (recording paper) by the secondary transfer device 22, thereby transferring and forming a color image on the sheets (recording paper). It is noted that toner remaining on the intermediate transfer member 50 after transfer of the image is cleaned by an intermediate transfer member cleaning device 17.

The sheets (recording paper) on which a color image is transferred and formed are conveyed by the secondary transfer device 22 and sent to a fixing device 25. Then, the synthesized color image (color transfer image) is fixed on the sheets (recording paper) by the fixing device 25 thermally under pressure. Thereafter, the sheets (recording paper) are changed over by a changeover pawl 55 and discharged by a discharge roller 56 and stacked on a discharge tray 57. Alternatively, the sheets are changed over by the changeover pawl 55, reversed by the sheet reversing device 28, and again guided to a transfer position to record an image on the back face. Thereafter, they are discharged by the discharge roller 56 and stacked on the output tray 57.

In the image forming method of the present invention, since the toner of the present invention is used, a sufficient image density can be obtained to decrease the toner amount deposited on a recording medium per unit area, thereby forming a high quality image.

According to the present invention, there are solved conventional problems and also provided a toner for developing an electrostatic charge image capable of obtaining a sufficient image density and decreasing the toner amount per unit area deposited on a recording medium such as paper, a method for manufacturing the toner for developing an electrostatic charge image and an image forming method.

EXAMPLES

Hereinafter, a description will be given of examples of the present invention. However, it should be noted that the present invention is not limited to these examples in any way.

Example 1

-Synthesis of Polyester Resin-

Bisphenol A ethylene oxide 2-mole addition product (690 parts by mass) and terephthalic acid (335 parts by mass) were added to a reaction vessel equipped with a cooling tube, agitator and nitrogen introducing tube and subjected to condensation reaction at 210° C. for 10 hours under atmospheric nitrogen current.

Next, the resultant was allowed to react continuously for 5 hours, with dehydration, under a reduced pressure of from 10 mmHg to 15 mmHg, and then cooled to obtain a polyester resin (1).

The thus obtained polyester resin (1) was 6,000 in weight average molecular weight, 10 mgKOH/g in acid value and 48° C. in glass transition temperature.

-Synthesis of Prepolymer-

Bisphenol A ethylene oxide 2-mole addition product (795 parts by mass), isophthalic acid (200 parts by mass), terephthalic acid (65 parts by mass) and dibutyltin oxide (2 parts by mass) were respectively added to a reaction vessel equipped with a cooling tube, agitator and nitrogen introducing tube and subjected to condensation reaction at 210° C. for 8 hours under atmospheric nitrogen current.

Next, the resultant was allowed to react continuously for 5 hours, with dehydration, under a reduced pressure of from 10 mmHg to 15 mmHg and then cooled to 80° C. The resultant was also allowed to react with isophorone diisocyanate (170 parts by mass) for 2 hours in ethyl acetate to obtain a prepolymer (1).

The thus obtained prepolymer (1) was 5,000 in weight average molecular weight.

-Preparation of Organic Solvent Composition-

Ethyl acetate dispersion of 35% by mass carnauba wax (170 parts by mass), the polyester resin (1) (120 parts by mass), C. I. PY 155 (made by Clariant Japan K. K.) (20 parts by mass) as a yellow pigment, ethyl acetate (70 parts by mass) and isophorone diamine (2 parts by mass) were respectively fed into a vessel and agitated for 2 hours to effect dissolution and mixture.

Next, a high-efficiency disperser (Ebara Milder, made by Ebara Corporation) was used to circulate and mix the resultant for one hour and prepare an organic solvent composition (1).

The thus obtained organic solvent composition (1) was 4.5 mgKOH/g in acid value.

Next, the prepolymer (1) (25 parts by mass) and ethyl acetate (25 parts by mass) were respectively fed into another tank, agitated for 4 hours to effect dissolution and mixture. Thereby, an organic solvent composition (2) was obtained.

-Manufacture of Aqueous Medium-

Water (945 parts by mass), styrene-methacrylic acid-acrylic acid butyl copolymer of 20% by mass aqueous dispersion (40 parts by mass), 50% by mass sodium dodecyldiphenyl ether disulfonate aqueous solution (Eleminol MON-7, made by Sanyo Chemical Industries Ltd.) (160 parts by mass), and ethyl acetate (90 parts by mass) were respectively fed into a tank, mixed and agitated to obtain an aqueous medium (1).

-Solvent Removing Step-

The organic solvent composition (1), the organic solvent composition (2) and the dispersion medium (1) were supplied to a pipeline homomixer (made by Primix Corporation) respectively at a speed of 4,280 g/minute, 529 g/minute and 8,190 g/minute, and subjected to a 300-minute continuous operation at 2,960 rpm to obtain an emulsified dispersion of 3,900 kg.

The thus obtained emulsified dispersion is stored at a SUS-made tank equipped with a hot-water jacket and a reduced-pressure line, gradually reduced in pressure while agitated at the circumferential speed of 10.5 m/second on the outer circumference end of an agitator blade, with attention given so as to avoid a sudden boiling, and the solvent removal was conducted as follows under the final pressure reducing condition of −90 kPa.

In this instance, the concentration of an organic solvent before the start of an organic solvent removing step was given as a starting point. The concentration was obtained by using a gas chromatograph (GC-2010, made by Shimadzu Corporation) to measure the concentration of the organic solvent remaining in the emulsified dispersion before and after the start of removing the organic solvent at every predetermined interval. The concentration of the organic solvent at the starting point was 18.8% by mass. It is noted that in the following Examples 2 to 5 and Comparative Examples 1 to 3, the concentration was measured at the same starting point.

[STEP 1]: The solvent was heated up to 23° C. over 2.5 hours from the starting point until the concentration of the organic solvent reached less than 12% by mass.

[STEP 2]: The solvent was heated from 23° C. to 38° C. over one hour until the concentration of the organic solvent reached less than 5% by mass.

[STEP 3]: The solvent was heated from 38° C. to 48° C. over one hour until the concentration of the organic solvent reached less than 1% by mass.

[STEP 4]: The solvent was heated from 48° C. to 57.5° C. over 1.5 hours until the concentration of the organic solvent reached less than 0.1% by mass.

In Example 1, a temperature range calculated by the following formula (1) under the solvent removing conditions (X=2.5 hours, T=23° C.) was 8<T(° C.)<42, and the solvent removing conditions of Example 1 have satisfied the following formula (1). These results are summarized and shown in Table 1.

$$5\{\exp(-0.2X)+1\} \leqq T \leqq 50X^{-0.2} \quad \text{Formula (I)}$$

-Preparation of Toner-

Thereafter, the thus obtained emulsified dispersion product was filtrated, washed and subjected to drying to prepare a toner base material.

Next, a charge control agent (Bontron E-84, made by Orient Chemical Industries, Ltd.) (0.25 parts by mass) was mixed with the thus obtained toner base material (100 parts by mass) by using a Q-type mixer (made by Mitsui Mining Co., Ltd.)

Next, hydrophobic silica (H2000, made by Clariant Japan K.K.) (0.5 parts by mass) was added thereto and mixed by using a Henschel mixer. Further, hydrophobic silica (0.5 parts by mass) and hydrophobic titanium oxide (0.5 parts by mass) were mixed by using a Henschel mixer, and a screen (mesh size of 37 μm) was used to remove large particles to prepare a yellow toner (1).

The thus obtained toner was determined for the void ratio by the following procedures.

<Determination of Toner Void Ratio>

The toner was embedded with an epoxy resin and fixed and retained on a substrate and an ultra microtome (RM2265, made by Leica Camera AG) was used to smooth the surface of the toner-embedded resin. Thereafter, the surface of the resin on the substrate was photographed using a scanning-type electron microscope (FE-SEM S-4800, made by Hitachi Ltd.). Five average sites were measured and binarized using Photoshop. Then, image processing software (Image Plus Pro) was used to evaluate the diameter of the voids and the distribution state. The void ratio was calculated as an area ratio (%) of voids to the toner area. A total of 300 particles or more of toner particles (5 sites) were analyzed for one sample.

Figure 6:
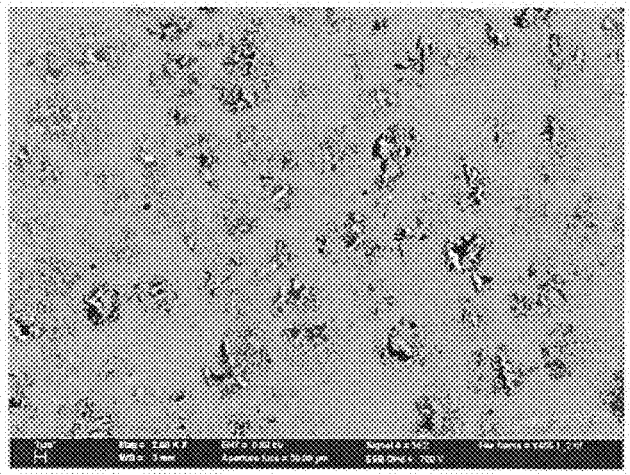
FIG. 6 shows an FE-SEM image taken in Example 1.

FIG. 6 shows an image photographed by the FE-SEM electron microscope, which is the cross section of the toner prepared in Example 1. Black parts given in the FE-SEM picture of FIG. 6 were voids inside toner particles. The void ratio of the toner prepared in Example 1 was 3.4%.

Example 2

-Manufacture of Toner-

An emulsified dispersion of 3,900 kg was prepared under the same toner manufacturing conditions as those of Example 1.

Next, the solvent was removed in the same manner described in Example 1 except that the time and temperature were respectively given as X=0.5 hours and T=15° C. in STEP 1 of the solvent removing steps (until the concentration of the remaining organic solvent is less than 12%). It is noted that the concentration of the organic solvent at the starting point was 22.5% by mass. Then, steps after aging were conducted in the same manner described in Example 1 to prepare a toner base material.

The thus obtained toner base material was subjected to the same treatment as that of Example 1, thereby preparing a yellow toner (2).

Figure 7:
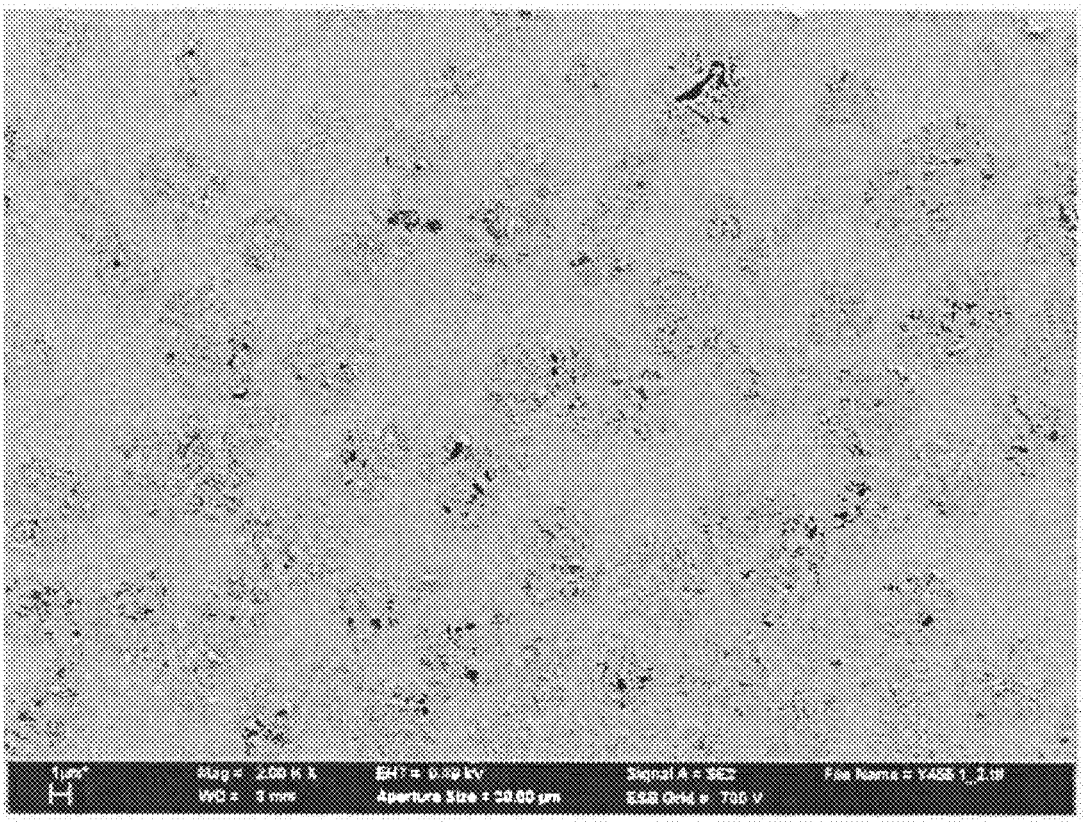
FIG. 7 shows an FE-SEM image taken in Example 2.

The thus obtained yellow toner (2) of Example 2 was measured for the void ratio of the toner in the same manner as described in Example 1. FIG. 7 shows an image photographed by the FE-SEM electron microscope, which is the cross section of toner particles. Black parts given in the FE-SEM picture of FIG. 7 were voids inside the toner particles. The void ratio of the toner was 1.3%.

Example 3

-Manufacture of Toner-

An emulsified dispersion (3,900 kg) was prepared under the same toner manufacturing conditions as those of Example 1.

Next, the solvent was removed in the same manner described in Example 1 except that the time and temperature were given respectively as X=12 hours and T=23° C. in STEP 1 of the solvent removing steps (until the concentration of the remaining organic solvent is less than 12%). It is noted that the concentration of the organic solvent at the starting point was 17.0% by mass. Then, steps after aging were conducted in the same manner described in Example 1 to prepare a toner base material.

The thus obtained toner base material was subjected to the same treatment as that of Example 1, thereby preparing a yellow toner (3).

The thus obtained yellow toner (3) of Example 3 was measured for the void ratio in the same manner as described in Example 1. The void ratio was 6.3%.

Example 4

-Manufacture of Toner-

An emulsified dispersion (3,900 kg) was prepared under the same toner manufacturing conditions as those of Example 1.

Next, the solvent was removed in the same manner as described in Example 1 except that the time and temperature were given respectively as X=24 hours and T=23° C. in STEP 1 of the solvent removing steps (until the concentration of the remaining organic solvent reaches less than 12%). It is noted that the concentration of the organic solvent at the starting point was 17.0% by mass. Then, steps after aging were conducted in the same manner described in Example 1 to prepare a toner base material.

The thus obtained toner base material was subjected to the same treatment as that of Example 1, thereby preparing a yellow toner (4).

The thus obtained yellow toner (4) of Example 4 was measured for the void ratio in the same manner as described in Example 1. The void ratio was 8.9%.

Example 5

-Manufacture of Toner-

An emulsified dispersion of 3,900 kg was prepared under the same toner manufacturing conditions as those of Example 1.

Next, the solvent was removed in the same manner as described in Example 1 except that the time and temperature were given respectively as X=2.5 hours and T=38° C. in STEP 1 of the solvent removing steps (until the concentration of the remaining organic solvent is less than 12%). It is noted that the concentration of the organic solvent at the starting point was 18.8% by mass. Then, steps after aging were conducted in the same manner described in Example 1 to prepare a toner base material.

The thus obtained toner base material was subjected to the same treatment as that of Example 1, thereby preparing a yellow toner (5).

The thus obtained yellow toner (5) of Example 5 was measured for the void ratio in the same manner described in Example 1. The void ratio was 9.8%.

Comparative Example 1

-Manufacture of Toner-

An emulsified dispersion of 3,900 kg was prepared under the same toner manufacturing conditions as those of Example 1.

Next, the solvent was removed in the same manner described in Example 1 except that the time and temperature were given respectively as X=2.5 hours and T=50° C. in STEP 1 of the solvent removing steps (until the concentration of the remaining organic solvent is less than 12%). It is noted that the concentration of the organic solvent at the starting point was 18.8% by mass. Then, steps after aging were conducted in the same manner as described in Example 1 to prepare a toner base material.

The thus obtained toner base material was subjected to the same treatment as that of Example 1, thereby preparing a yellow toner (6).

The thus obtained yellow toner (6) of Comparative Example 1 was measured for the void ratio in the same manner as described in Example 1. The void ratio was 12.3%.

Comparative Example 2

-Manufacture of Toner-

An emulsified dispersion (3,900 kg) was prepared under the same toner manufacturing conditions as those of Example 1.

Next, the solvent was removed in the same manner described in Example 1 except that the time and temperature were given respectively as X=12 hours and T=38° C. in STEP 1 of the solvent removing steps (until the concentration of the remaining organic solvent is less than 12%). It is noted that the concentration of the organic solvent at the starting point was 17.0% by mass. Then, steps after aging were conducted in the same manner as described in Example 1 to prepare a toner base material.

The thus obtained toner base material was subjected to the same treatment as that of Example 1, thereby preparing a yellow toner (7).

The thus obtained yellow toner (7) of Comparative Example 2 was measured for the void ratio in the same manner described in Example 1. The void ratio was 15.6%.

Comparative Example 3

-Manufacture of Toner-

An emulsified dispersion of 3,900 kg was prepared under the same toner manufacturing conditions as those of Example 1.

Next, the solvent was removed in the same manner described in Example 1 except that the time and temperature were given respectively as X=1 hour and T=5° C. in STEP 1 of the solvent removing steps (until the concentration of the remaining organic solvent reaches less than 12%). It is noted that the concentration of the organic solvent at the starting point was 22.5% by mass. Then, steps after aging were conducted in the same manner described in Example 1 to prepare a toner base material.

The thus obtained toner base material was subjected to the same treatment as that of Example 1, thereby preparing a yellow toner (8).

The thus obtained yellow toner (8) of Comparative Example 3 was measured for the void ratio in the same manner as described in Example 1. The void ratio was 0.03%.

TABLE 1

| | Void ratio | Time x | Temperature | Formula (1) | |
|---|---|---|---|---|---|
| | [%] | [hour] | T [° C.] | $5\{\exp(-0.2x)+1\}$ | $50x^{-0.2}$ |
| Ex. 1 | 3.4 | 2.5 | 23 | 8 | 42 |
| Ex. 2 | 1.3 | 0.5 | 15 | 10 | 57 |
| Ex. 3 | 6.3 | 12 | 23 | 5 | 30 |
| Ex. 4 | 8.9 | 24 | 23 | 5 | 26 |
| Ex. 5 | 9.8 | 2.5 | 38 | 8 | 42 |

TABLE 1-continued

| | Void ratio | Time x | Temperature | Formula (1) | |
|---|---|---|---|---|---|
| | [%] | [hour] | T [° C.] | $5\{\exp(-0.2x)+1\}$ | $50x^{-0.2}$ |
| Comp. Ex. 1 | 12.3 | 2.5 | 50 | 8 | 42 |
| Comp. Ex. 2 | 15.6 | 12 | 38 | 5 | 30 |
| Comp. Ex. 3 | 0.03 | 1 | 5 | 9 | 50 |

-Preparation of Carrier-

A coating material with the following compositions was dispersed for 10 minutes by using a stirrer to prepare a coating solution. The thus obtained coating solution and a core were fed into a coating device equipped with a rotating bottom-plate disk and an agitation blade inside a fluidized bed to effect coating, with a circulating flow provided, thereby coating the coating solution on the core. The thus obtained coated product was incinerated inside an electric oven at 250° C. for 2 hours to prepare a carrier.

Mn ferrite particles as a core (weight average particle diameter=35 μm); 5,000 parts by mass Compositions of the coating material Toluene; 450 parts by mass Silicone resin (product name: SR 2400, non-volatile portion of 50%, made by Dow Corning Toray Silicone Co., Ltd.; 450 parts by mass Amino silane (product name: SH6020, Dow Corning Toray Silicone Co., Ltd.); 10 parts by mass Carbon black; 10 parts by mass -Preparation of Developer- Ferrite carrier with an average particle diameter of 35 μm was coated with a silicone resin to give an average thickness of 0.5 μm. Each of the above-prepared toners (7 parts by mass) was uniformly mixed with the carrier (100 parts by mass) by using Turbular mixer in which the container rotates to effect agitation for charging. In this way respective developers were prepared.

-Image Evaluation-

The thus obtained developers were respectively set on an image forming apparatus (IPSIO color 8000, made by Ricoh Company, Ltd.) to print 50,000 sheets continuously at an image area rate of 5% on an analog output basis, which was evaluated as follows. The results are shown in Table 2.

<Determination of Image Density>

After the analog output, the developers were respectively determined for the image density at five points by using X-Rite 969 (made by X-Rite Inc.) to calculate an average value, which was evaluated on the basis of the following criteria. It is noted that a practically usable level is an image density of 1.4 or more.

[Evaluation Criteria]

A: image density of 1.5 or more

B: image density of 1.4 or more but less than 1.5

C: image density of less than 1.4

<Evaluation of Deposited Toner Amount>

Evaluation was made for the deposited toner amount required to obtain sufficient image density. A solid image (2 cm×2 cm) was formed on a developing sleeve, which was not transferred to a sheet but peeled from the developing sleeve by using a commercially available double-sided adhesive tape. Then, the deposited toner amount (gram) per unit area was measured by comparing the weights of the tape between before and after toner deposition. The results were evaluated on the basis of the following criteria.

[Evaluation Criteria]

A: less than 0.5 g (range at which a necessary image density is obtained with a small toner quantity)

B: 0.5 g or more (range at which a large toner quantity is necessary for obtaining a sufficient image density)

TABLE 2

| | Image density | Deposited toner amount |
|---|---|---|
| Ex. 1 | A | A |
| Ex. 2 | A | A |
| Ex. 3 | A | A |
| Ex. 4 | B | A |
| Ex. 5 | B | A |
| Comp. Ex. 1 | C | A |
| Comp. Ex. 2 | C | A |
| Comp. Ex. 3 | A | B |

The toner manufactured by the toner manufacturing method of the present invention is capable of obtaining a sufficient image density and reducing the deposited toner amount per unit area on a recording medium such as paper, and is also favorably used in high-quality image formation using electrophotography. Further, an image forming method using the toner of the present invention is favorably used in various types of image forming apparatuses using electrophotography.

What is claimed is:

1. A toner manufacturing method comprising:

dissolving or dispersing a toner material into an organic solvent to prepare a toner solution, the toner material containing at least an active hydrogen group-containing compound, a polymer reactive with the active hydrogen group-containing compound, a binder resin, a releasing agent and a coloring agent;

emulsifying or dispersing the toner solution into an aqueous medium to prepare an emulsified dispersion;

reacting the active hydrogen group-containing compound with the polymer reactive with the active hydrogen group-containing compound in the aqueous medium produce an adhesive base material in the form of particle; and removing the organic solvent, wherein time X (hour) from a point where the organic solvent starts to be removed to a point where the concentration of the organic solvent reaches less than 12% by mass and temperature T (° C.) of the emulsified dispersion at the time X satisfy the relationship $5\{\exp(-0.2X)+1\} \leqq T \leqq 50X^{-0.2}$.

2. The toner manufacturing method according to claim 1, wherein the temperature T of the emulsified dispersion at the time X is from 10° C. to 70° C.

3. The toner manufacturing method according to claim 1, wherein the time X is 15 hours or less and the temperature T is 40° C. or lower.

4. The toner manufacturing method according to claim 1, wherein the organic solvent is removed at least either under reduced pressure or on heating.

5. The toner manufacturing method according to claim 4, wherein the heating is conducted by allowing one of hot water and steam to pass through a jacket mounted to the outer circumference of a storage tank which accommodates the organic solvent or by heating the storage tank by means of a heater.

6. The toner manufacturing method according to claim 4, wherein the pressure is reduced to a level of −80 kPa or less.

7. The toner manufacturing method according to claim 1, wherein the binder resin contains a polyester resin.

8. A toner manufactured by a toner manufacturing method which comprises:

dissolving or dispersing a toner material into an organic solvent to prepare a toner solution, the toner material containing at least an active hydrogen group-containing compound, a polymer reactive with the active hydrogen group-containing compound, a binder resin, a releasing agent and a coloring agent;

emulsifying or dispersing the toner solution into an aqueous medium to prepare an emulsified dispersion;

reacting the active hydrogen group-containing compound with the polymer reactive with the active hydrogen group-containing compound in the aqueous medium produce an adhesive base material in the form of particle; and removing the organic solvent, wherein time X (hour) from a point where the organic solvent starts to be removed to a point where the concentration of the organic solvent reaches less than 12% by mass and temperature T (° C.) of the emulsified dispersion at the time X satisfy the relationship $5\{\exp(-0.2X)+1\} \leqq T \leqq 50X^{-0.2}$.

9. The toner according to claim 8, wherein a cross section of the toner has a void ratio of from 0.1% to 10%.

10. An image forming method comprising:

forming a latent electrostatic image on a latent electrostatic image bearing member;

developing the latent electrostatic image using a toner to form a visible image;

transferring the visible image to a recording medium; and fixing the visible image to the recording medium, wherein the toner is manufactured by a toner manufacturing method which comprises:

dissolving or dispersing a toner material into an organic solvent to prepare a toner solution, the toner material containing at least an active hydrogen group-containing compound, a polymer reactive with the active hydrogen group-containing compound, a binder resin, a releasing agent and a coloring agent;

emulsifying or dispersing the toner solution into an aqueous medium to prepare an emulsified dispersion;

reacting the active hydrogen group-containing compound with the polymer reactive with the active hydrogen group-containing compound in the aqueous medium produce an adhesive base material in the form of particle; and removing the organic solvent, wherein time X (hour) from a point where the organic solvent starts to be removed to a point where the concentration of the organic solvent reaches less than 12% by mass and temperature T (° C.) of the emulsified dispersion at the time X satisfy the relationship $5\{\exp(-0.2X)+1\} \leqq T \leqq 50X^{-0.2}$.

* * * * *